US008747247B2

(12) United States Patent
Beach et al.

(10) Patent No.: US 8,747,247 B2
(45) Date of Patent: Jun. 10, 2014

(54) GOLF CLUB SHAFT

(75) Inventors: Todd P. Beach, San Diego, CA (US); Drew T. DeShiell, Oceanside, CA (US); John Francis Lorentzen, El Cajon, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 241 days.

(21) Appl. No.: 13/442,623

(22) Filed: Apr. 9, 2012

(65) Prior Publication Data

US 2012/0258817 A1 Oct. 11, 2012

Related U.S. Application Data

(63) Continuation-in-part of application No. 12/887,762, filed on Sep. 22, 2010, now Pat. No. 8,491,408.

(60) Provisional application No. 61/278,536, filed on Oct. 7, 2009.

(51) Int. Cl.
*A63B 53/16* (2006.01)

(52) U.S. Cl.
USPC ..... 473/296; 403/109.5

(58) Field of Classification Search
USPC ..... 473/293–299, 239, 318; 403/109.1–109.8, 377–379.6
See application file for complete search history.

(56) References Cited

U.S. PATENT DOCUMENTS 3,539,185 A 11/1970 Andis
4,100,748 A * 7/1978 Hansen ..... 405/259.3
4,674,747 A 6/1987 Mazzocco et al.
5,282,619 A 2/1994 Napolitano et al.
D364,436 S 11/1995 Thomas
5,569,096 A 10/1996 Lee
6,029,813 A 2/2000 Smolenski
6,413,168 B1 7/2002 McKendry et al.
6,780,120 B2 8/2004 Murray
6,875,123 B2 4/2005 Wilson
6,953,313 B2 10/2005 Tylosky
7,018,302 B2 3/2006 Jacoby
7,074,135 B2 7/2006 Moore
7,147,568 B1 12/2006 Butler
7,186,050 B2 * 3/2007 Dean et al. ..... 403/344
7,316,622 B1 1/2008 Lucas
7,320,647 B2 1/2008 Murray
7,435,185 B1 10/2008 Butler
7,544,134 B1 6/2009 Harmon et al.
7,563,173 B2 7/2009 Chol
7,704,159 B1 4/2010 McDonald
7,722,474 B2 5/2010 Thomas et al.
7,758,446 B2 7/2010 Hodgetts
8,485,915 B2 * 7/2013 Evans ..... 473/296

* cited by examiner

*Primary Examiner* — Stephen L. Blau
(74) *Attorney, Agent, or Firm* — Klarquist Sparkman, LLP

(57) ABSTRACT

An adjustable length golf club shaft having a grip portion with an end point is disclosed. A locking element is located within the grip portion and a lower shaft having an inner surface that is in frictional contact with the locking element is also disclosed. The locking element is configured to engage the inner surface of the lower shaft. A total length of the golf club shaft is adjustable by a distance of at least one inch and a total weight of the golf club shaft in a weight zone is less than 110 g. The weight zone is defined as a region of the golf club shaft extending from the end point of the grip portion up to 11" along a central axis of the golf club shaft toward a tip portion of the shaft.

20 Claims, 17 Drawing Sheets

GOLF CLUB SHAFT

CROSS REFERENCE TO RELATED APPLICATION

This application is a continuation-in-part of U.S. patent application Ser. No. 12/887,762, filed Sep. 22, 2010, now U.S. Pat. No. 8,491,408 which is a non-provisional application claiming priority to and benefit of U.S. Provisional Patent Application No. 61/278,536, filed Oct. 7, 2009. Each of the foregoing patent applications is incorporated herein by reference.

FIELD

The present disclosure relates to a golf club shaft. More specifically, the present disclosure relates to an adjustable golf club shaft.

BACKGROUND

Golf is a game in which a player, using many types of clubs, hits a ball into each hole on a golf course in the lowest possible number of strokes. A metal wood is typically used at a tee box to strike the ball a long distance.

Typical metal wood shafts are a fixed length and cannot be adjusted. A grip on a typical metal wood shaft is stationary with respect to the club head and a user would need to cut the shaft to make it shorter or purchase another shaft to increase the length.

SUMMARY OF THE DESCRIPTION

In one embodiment, the present disclosure describes a golf club head comprising a heel portion, a toe portion, a crown, a sole, and a face.

According to one aspect of the present invention, an adjustable length golf club is provided having an engaging mechanism, a drive shaft, a locking element, and a lower shaft. The drive shaft is connected with the engaging mechanism and is configured to rotate upon movement by the engaging mechanism.

In one example of the present invention, an adjustable length golf club shaft is described including a grip portion. The grip portion has an end region including an end point. A locking element located within the grip portion is also described. A lower shaft having an inner surface is in frictional contact with the locking element. The locking element is configured to engage the inner surface of the lower shaft. A total length of the golf club shaft is adjustable by a distance of at least one inch and a total weight of the golf club shaft in a weight zone is less than 110 g. The weight zone is defined as a region of the golf club shaft extending from the end point of the grip portion to 11" along a central axis of the golf club shaft toward a tip portion of the shaft.

The grip portion is adjustable with respect to the lower shaft and a stop prevents the lower shaft from being completely removed from the grip portion. The total length of the golf club shaft is adjustable by a distance of at least 2 inches, 3 inches, or 4 inches.

The total weight of the golf club shaft in the weight zone is less than 85 g, less than 75 g, less than 65 g, or less than 55 g.

In yet another example, the locking element prevents any axial movement between the grip portion and the lower shaft during an axial load of at least 2000 N.

In another example, a first keying feature portion is symmetrical about the central axis. The first keying portion can include at least one spline or three splines. The at least one first keying portion can include at least two keying regions along the lower shaft.

In one example, the grip portion includes at least one second keying feature portion configured to engage with the at least one first keying feature portion.

In yet another example, the total golf club length is between about 40" and about 48". The grip portion includes an upper shaft portion having an outside diameter of less than 0.700" and the lower shaft includes an outside diameter of greater than 0.450".

In one example, the grip portion includes an upper shaft portion having an outside diameter of less than 0.650" and the lower shaft includes an outside diameter of greater than 0.500".

According to one aspect of the present invention, an adjustable length golf club shaft is described having a lower portion and a grip portion connected with an engaging mechanism and a grip portion connected with the engaging mechanism. The grip portion includes an upper shaft portion having an outside diameter of less than 0.700". A shaft is connected with the engaging mechanism and is configured to rotate upon movement by the engaging mechanism. A locking element is connected with the shaft. The locking element includes at least one locking insert and at least one locking collar located on the at least one locking insert. The at least one locking insert is configured to engage the at least one locking collar during axial movement. A lower shaft having an inner surface that is in frictional contact with the at least one locking collar is described. The lower shaft includes an outside diameter of greater than 0.450". A first rotational movement in a first rotational direction by the shaft causes the at least one locking insert to engage the at least one locking collar creating a frictional locking engagement between the at least one locking collar and the inner surface of the lower shaft.

In yet another embodiment, the total length of the golf club shaft is adjustable by a distance of at least one inch and a total weight of the golf club shaft within a weight zone is less than 110 g. The weight zone is defined as a region of the golf club shaft extending from the end point of the grip portion to 11" along a central axis of the golf club shaft. A lower shaft having an inner surface that is in frictional contact with the locking element is described. A first rotational movement in a first rotational direction by the shaft causes the locking element to engage the inner surface of the lower shaft and a second rotational movement in a second rotational direction by the shaft causes the locking element to disengage from the inner surface of the lower shaft.

According to another aspect of the present invention, an adjustable length golf club is provided having a grip portion, a lower shaft, an engaging mechanism, a drive shaft, and a locking element. The drive shaft is connected with the engaging mechanism and is configured to rotate upon movement by the engaging mechanism. The grip portion has an end region including an end point. The locking element is located within the grip portion and has a first indexing member. The lower shaft has a second indexing member on an inner surface that selectively engages the first indexing member of the locking element. A ramp member is configured to translate axially relative to the locking element, thereby selectively transitioning the locking element into and out of engagement with the lower shaft.

In one example, the first indexing member is a plurality of male threads disposed on an outer surface of the locking element, and the second indexing member is a plurality of female threads disposed on the inner surface of the lower shaft.

In one example, the ramp member is a frusto-conical member that is selectively retractable into a body portion of the locking element. When the ramp member is retracted into the locking element, the ramp member imparts a force biasing a plurality of fingers of the locking element radially outward into engagement with the lower shaft.

In one example, a total length of the golf club shaft is adjustable by a distance of at least one inch and a total weight of the golf club shaft in a weight zone is less than 110 g. The weight zone is defined as a region of the golf club shaft extending from the end point of the grip portion to 11" along a central axis of the golf club shaft toward a tip portion of the shaft.

The foregoing and other objects, features, and advantages of the invention will become more apparent from the following detailed description, which proceeds with reference to the accompanying figures.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Figure 1:
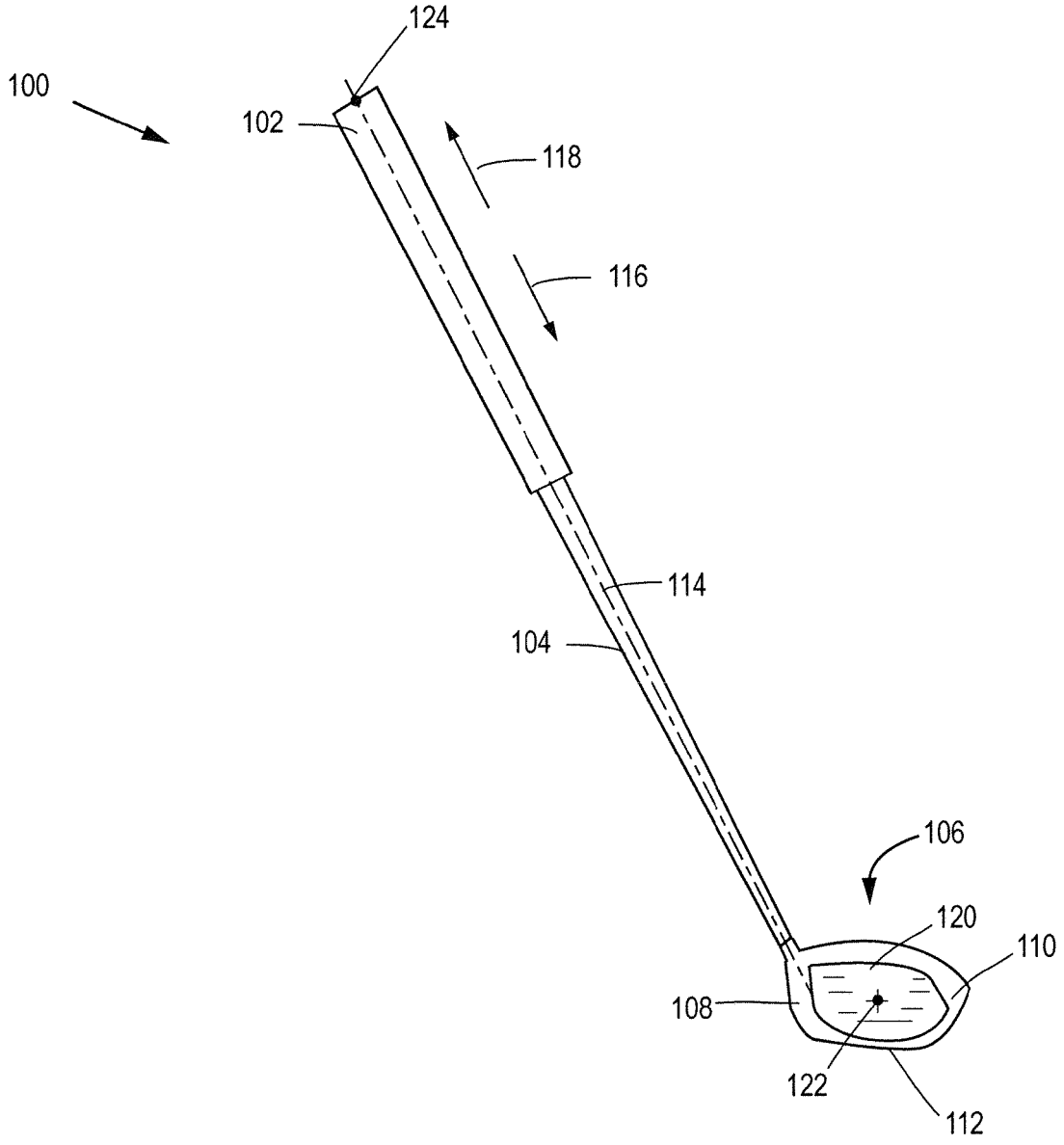
FIG. 1 is an illustration of an embodiment of a golf club according to the present disclosure.

FIG. 1 illustrates a golf club 100 comprising a grip portion 102, a lower shaft 104, and a club head 106. In the embodiment shown in FIG. 1, the golf club 100 is a metal wood-type club head, although the adjustable shaft described herein can be applied to any type of golf club including putters and irons. The club head 106 includes a heel 108, a toe 110, and a sole 112. The lower shaft 104 includes a centerline axis 114 that extends along the entire length and axial centerline of the golf club 100 shaft. A first axial direction 116 is shown to be extending in a direction toward the club head 106 and parallel with the shaft axis 114. In addition, FIG. 1 further shows a second axial direction 118 extending in a direction away from the club head 106 and opposite to the direction of the first axial direction 116. The second axial direction 118 is also parallel with the shaft axis 114. The golf club 100 further includes an endpoint 124 which is the farthest most point along the centerline axis 114 away from the club head 106.

The club head 106 includes a face portion 120 and a center face point 122 defined as the geometric center of the face portion 120. The center face point 122 is defined according to USGA "Procedure for Measuring the Flexibility of a Golf Clubhead," Revision 2.0, Mar. 25, 2005.

Figure 2:
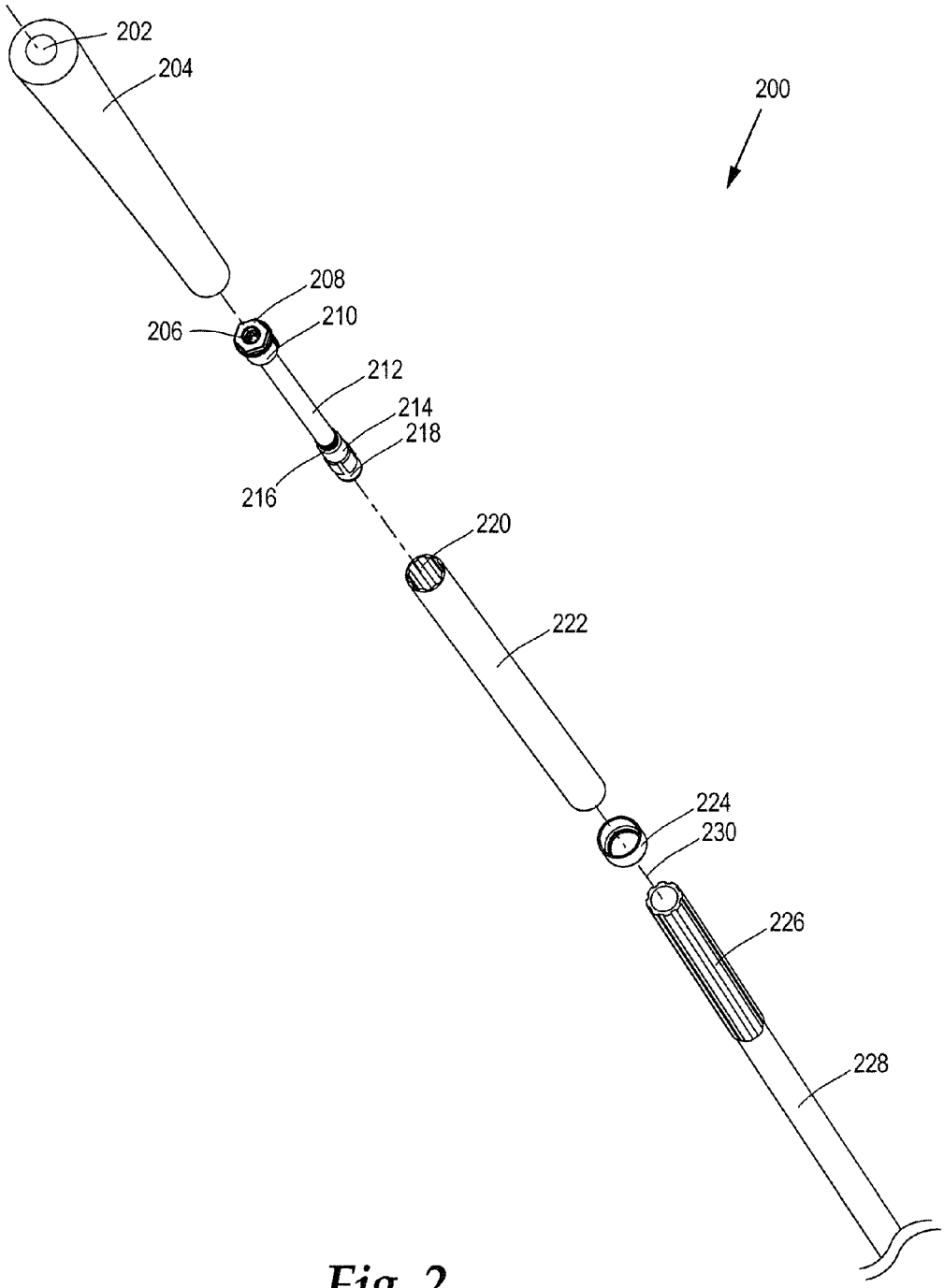
FIG. 2 is an exploded assembly view of an adjustable shaft according to a first embodiment.

FIG. 2 illustrates an exploded assembly view of an exemplary adjustable golf club shaft 200, according to one embodiment. The adjustable golf club shaft 200 includes a grip cover 204, a grip end opening 202, an upper housing portion 208, a lower housing portion 210, a drive bolt 206, a drive shaft 212, a stop 216, a locking element 214 or mechanism, a plug 218, an upper shaft 222, an upper shaft keying portion 220, a stop 224, a lower shaft 228, a lower shaft keying portion 226, and a centerline axis 230. The grip cover 204 (being a molded grip) and upper shaft 222 are herein referred to as a "grip portion."

Figure 3A:
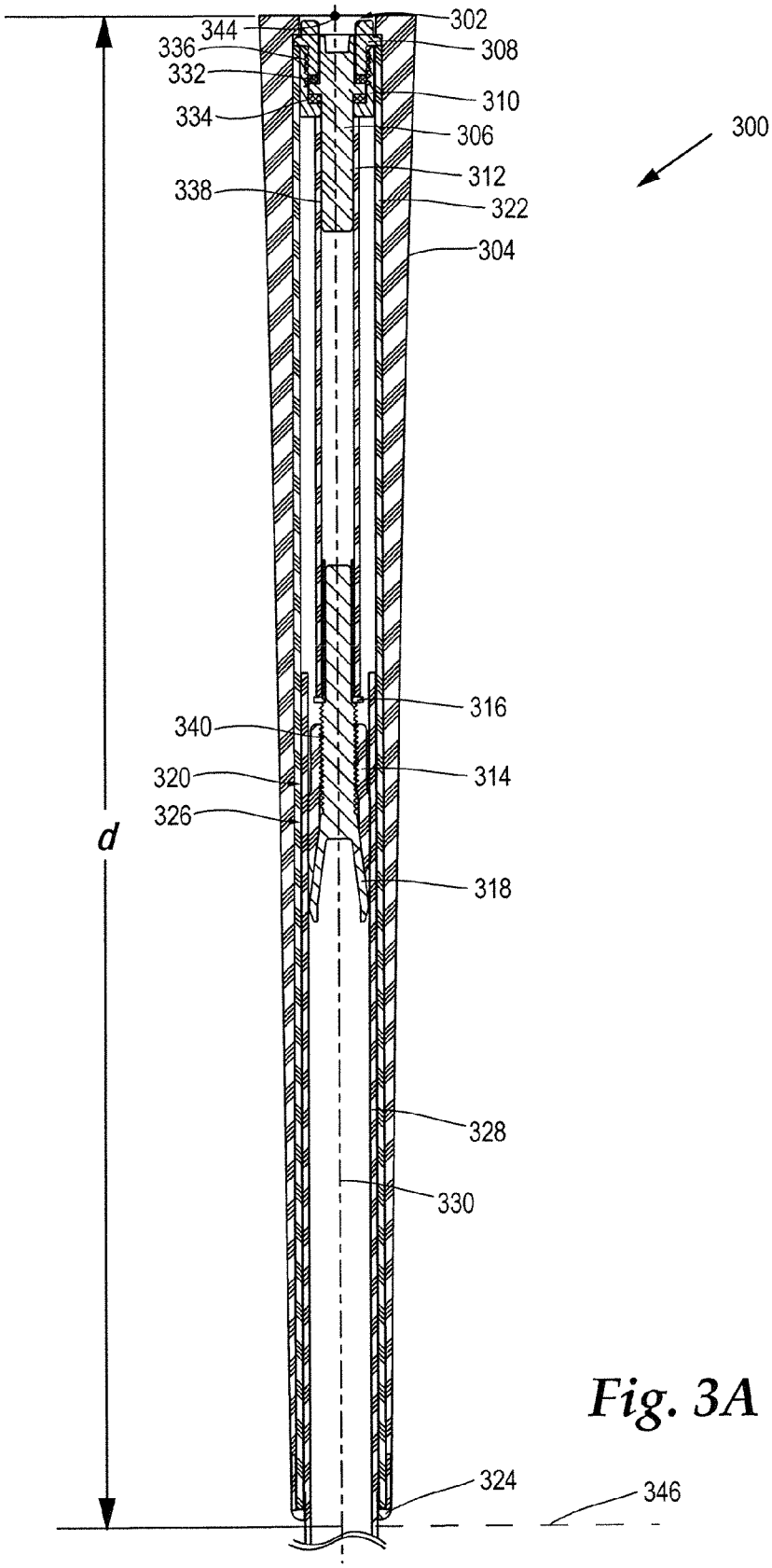
FIG. 3A is a cross-sectional assembled view of an adjustable shaft in a locked position.

FIG. 3A shows an assembled cross-sectional view of the adjustable golf club shaft 300 similar to the shaft as shown in FIG. 2. The grip cover 304 envelops an external surface of the upper shaft 322. The upper shaft 322 is coaxially aligned with the lower shaft 328 about the centerline axis 330. The upper shaft 322 and the lower shaft 328 have an overlapping region where the upper shaft 322 telescopically receives the lower shaft 328. The lower shaft 328 is slidably engaged with the upper shaft 322 so that the length of the lower shaft 328 is adjustable with respect to the upper shaft 322. However, an engaged keying region 320 allows the keying portion of the lower shaft 328 to engage with the keying portion of the upper shaft 322 to prevent rotation of the upper shaft about the lower shaft, as will be shown in further detail below.

In one embodiment, the upper shaft 322 is a graphite or carbon composite material while the lower shaft 328 is also a graphite or composite material. The lightweight construction of the upper shaft 322 and lower shaft 328 allows the weight of the adjustable club to be below a weight threshold.

FIG. 3A illustrates a grip cover 304, a grip end opening 302, an upper housing portion 308, a lower housing portion 310, a drive bolt 306, a drive shaft 312, a stop 316, a locking element 314, a plug 318, an upper shaft 322, an upper shaft keying portion 320, a stop 324, a lower shaft 328, a lower shaft keying portion 326, and a centerline axis 330, as previously described. The upper shaft keying portion 320 engages with the lower shaft keying portion 326 at a keying interface region. In FIG. 3A, the locking element 314 is shown in a locked position.

In addition, the upper housing portion 308 and the lower housing portion 310 are threadably engaged in an engagement region 336. The lower housing portion 310 receives the drive bolt 306 before securing the upper housing portion 308 to the lower housing portion 310. The drive bolt 306 further includes a ledge portion that retains the drive bolt 306 within the housing portions 308,310. The ledge portion of the drive bolt 306 is located between an upper washer 332 and a lower washer 334.

The drive bolt 306 includes a drive portion that is a six-pointed drive. It is understood that the drive portion can be a hex socket, phillips, slotted, TORX®, spline or other known drive configuration capable of receiving a driving tool.

In certain embodiments, the upper washer 332 is a polymeric material such as nylon 6/6 or thermoplastic material (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics). The lower friction and slight flexibility of the upper washer 332 ensures a secure engagement between the upper housing 308 and lower housing 310 while also allowing the drive bolt 306 to rotate about the centerline axis 330. In some embodiments, the lower washer 334 is any metallic material such as copper, tin, bronze, brass, copper, steel, or aluminum to allow a low friction engagement with the ledge portion of the drive bolt 306 thereby allowing a low friction rotation of the drive bolt 306.

It is understood that the upper washer 332 and lower washer 334 can be made of any of the materials described herein.

A lower portion of the drive bolt 306 is inserted into the upper end of the drive shaft 312. In one embodiment, the drive bolt 306 is adhesively attached to the drive shaft 312 by an adhesive epoxy along an interface surface 338. The amount of interface surface 338 is dependent on the length of the drive bolt 306. In other embodiments, the drive bolt 306 can be mechanically attached or pinned with a mechanical fastener or keyed to the drive shaft 312 to ensure the drive bolt 306 rotates simultaneously by the same amount as the drive shaft 312.

In addition, the drive bolt 306 is axially restrained by the upper and lower housing 308,310 while still being capable of rotating freely upon a user inserting an engaging tool with the drive bolt 306 through an opening 302 in the end of the grip. In other words, a user's tool engages the drive bolt 306 through the butt end of the grip. In certain embodiments, the drive bolt 306 is located within about 25.4 mm (1") of the end of the grip for easy access. In one embodiment, the upper housing 308 and/or lower housing 310 is bonded, welded, mechanically attached, or adhesively attached to an inner surface of the upper end of the upper shaft 322.

FIG. 3A further illustrates the stop 316 located in a lower end of the drive shaft 312. The stop 316 is partially inserted into the drive shaft 312 and acts to prevent the over engagement of the locking element 314 when the locking element is moved to an unlocked position directly adjacent to the stop 316. Without the presence of the stop 316, the locking element 314 may become undesirably lodged when the locking element 314 is moved to a fully disengaged position in a second axial direction 118 along the centerline 330. In other words, the stop 316 helps prevent the locking element 314 from becoming immobilized or "stuck" when fully moved to an unlocked position. As shown in FIG. 3A, the locking element 314 is located in a fully locked position where portions or fingers/arms of the locking element 314 are wedged between the plug 318 and the interior surface of the lower shaft 328, as will be described in further detail. The plug 318 includes a threaded portion 340 that engages with a threaded region of the locking element 314.

In one embodiment, the stop 324 is located at the lower end of the upper shaft 322 and acts to ensure a smooth engagement between the upper shaft 322 and lower shaft 328. The stop 324 also prevents the full disengagement of the upper shaft 322 from the lower shaft 328.

In certain embodiments, a weight zone is defined by an offset plane 346 that is measured from the end point 344 along the centerline axis 330 by a weight zone distance, d. The weight zone distance, d, is about 279.4 mm (11 inches) as measured along the centerline axis 330.

The offset plane 346 is perpendicular to the centerline axis 330. The weight zone extends between the endpoint 344, as previously described, and the offset plane 346 when the lower shaft 328 is fully inserted or retracted in the upper shaft 322. In the fully retracted position, the weight zone has the heaviest weight configuration. Therefore, the components within the weight zone must be below a certain weight in order to avoid a negative impact on the swing of a golfer. If the total weight of the club within the weight zone (including all parts and materials within the weight zone) is too heavy, the golfer may not experience the desired feel and performance.

In certain embodiments, the total weight of the club within the weight zone is less than 110 g or between about 110 g and about 15 g. In some embodiments, the total weigh of the club within the weight zone is less than 85 g or between about 85 g and about 20 g. In one embodiment, the total weight of the club within the weight zone is less than 75 g or between about 75 g and about 25 g. In some embodiments, the total weight of the club within the weight zone is less than 65 g or between about 65 g and about 25 g. Furthermore, in certain embodiments, the total weight of the club within the weight zone is less than 55 g or between about 55 g and about 25 g.

Figure 3B:
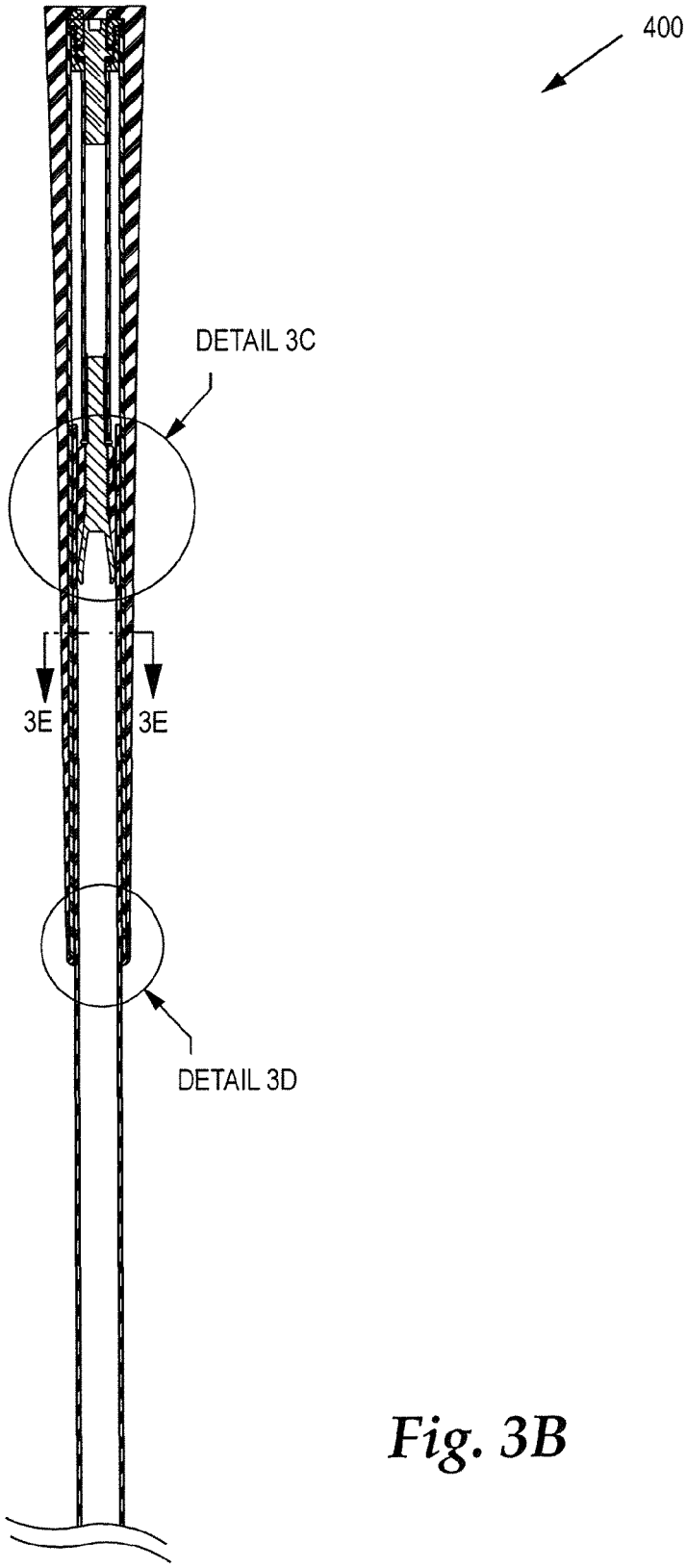
FIG. 3B is a cross-sectional assembled view of an adjustable shaft in an unlocked position.

FIG. 3B illustrates the same embodiment shown in FIG. 3A having the components described above and the locking element 314 in an unlocked position.

Figure 3C:
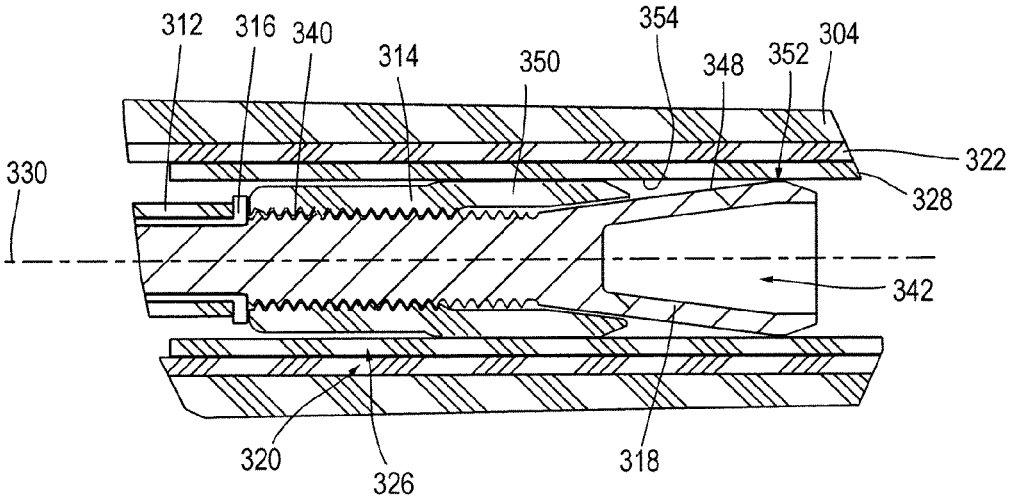
FIG. 3C is a detailed cross-sectional view of a locking element taken from FIG. 3B.

FIG. 3C shows a detailed view of the locking element 314 in the unlocked position as taken from FIG. 3B. The plug body 318 includes a hollowed region 342 that reduces the overall weight of the plug 318. In addition, the plug 318 includes a threaded region 340 that receives the locking element 314. In the unlocked position, the locking element is moved in the second axial direction 118 and a top portion of the locking element abuts or is in direct contact with the stop 316. As previously mentioned, the stop 316 prevents an over-tightening of the locking element 314 on the threads 340. The locking element 314 fingers or protrusions 350 are no longer wedged or engaged between the plug surface 348 and the interior wall 354 of the lower shaft 328. Therefore, the upper shaft 322, drive shaft 312, and locking assembly including the locking element 314 and plug 318 are able to move in either a first axial direction 116 or second axial direction 118 with respect to the lower shaft 328.

In use, in one embodiment, a first rotational movement by the drive bolt 306 and drive shaft 312 causes the plug 318 to rotate while the locking element 314 remains rotationally restrained or stationary through the frictional engagement interface 352 (or other means described in further detail) with the interior wall 354. As the plug 318 rotates and engages the locking element 314 through the threaded portion 340, the locking element 314 moves in the first axial direction 116. Even though the locking element 314 is rotationally restrained, the locking element 314 is able to move in an axial direction parallel with the centerline axis 330 while being rotationally restrained. A movement of the locking element 314 in the first axial direction 116 causes a portion of the locking element 314 to engage or wedge between the inner surface of the lower shaft 328 and an outer surface 348 of the plug 318 into a locking position. The friction created between the threaded region 340 of the plug 318 and the locking element 314 during rotation is relatively low when compared to the friction between the outer surface of the locking element 314 and the inner surface 354 of the lower shaft 328. Thus, after locking, the adjustable golf club shaft 300 is ready for use. In other words, a force applied by the user on either the upper shaft 322 or the lower shaft 328 will not cause any rotational or axial movement between the upper shaft 322 and lower shaft 328 due to the locking element 314 being engaged.

In contrast, a second rotational movement by the drive shaft 312 in an opposite direction of the first rotational movement causes the locking element 314 to disengage from the inner surface 354 of the lower shaft 328 and the plug 318. Therefore, the locking element 314 will move in the second axial direction 118 with respect to the lower shaft 328. Thus, after unlocking, the adjustable golf club shaft 300 can be adjusted by the user to a desired position before re-engaging the locking element 314.

In certain embodiments, the upper shaft 322 can travel at least 76.2 mm (3 inches) or 101.6 mm (4 inches). In other embodiments, the upper shaft 322 can travel between about 101.6 mm (4 inches) and 254 mm (10 inches). Depending on the type of shaft, the upper shaft 322 can travel more than 254 mm (10 inches) with respect to the lower shaft 328.

Figure 3D:
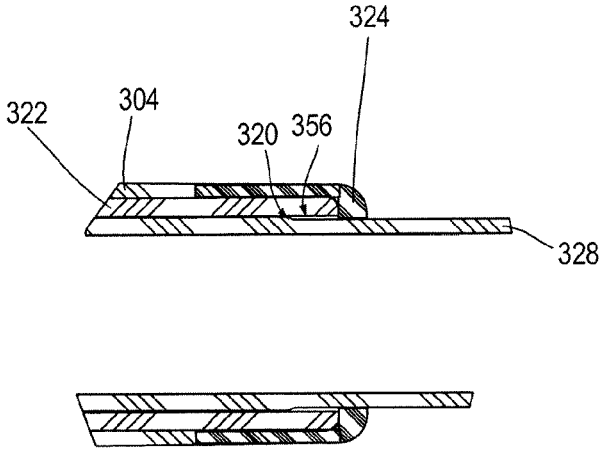
FIG. 3D is a detailed view of a stop taken from FIG. 3B.

FIG. 3D illustrates a detailed view of the stop 324 located at an end of the upper shaft 322 taken from FIG. 3B. In some embodiments, the stop 324 may act as a stop that prevents the lower shaft 328 from being completely removed from the upper shaft 322 in the first axial direction 116. In one embodiment, the stop 324 is in direct engagement with the outside diameter surface of the lower shaft 328. A keying portion 320 of the lower shaft 328 has a greater outside diameter than the inside diameter of the stop 324. A small gap 356 is present between the non-keyed portion of the lower shaft 328 and the inside diameter of the upper shaft. Therefore, when the upper shaft 322 is fully extended in the second axial direction 118, the keying portion 320 of the lower shaft 328 engages with the protruding ledge of the stop 324 to prevent full disengagement.

Figure 3E:
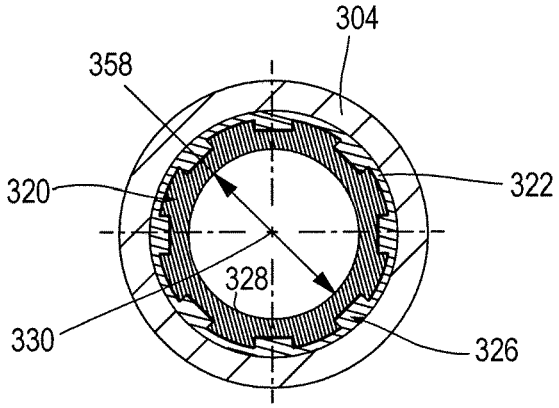
FIG. 3E is a cross-sectional view taken along cross-sectional lines 3E-3E in FIG. 3B.

FIG. 3E illustrates a cross-sectional view taken along cross-section lines 3E-3E in FIG. 3B. In one embodiment, the keying portions 320,326 are shown to be interlocking splines. In one example, the keying portions 320 of the lower shaft 328 include about eight splines. It is understood any number of splines can be used such as between one and sixteen splines. The keying portions 326 of the upper shaft 322 are configured to conform with the keying portions 320 of the lower shaft 328. The interlocking keying portions 320,326 ensure that a rotational motion is prevented between the two shafts. The keying portions 320,326 are symmetrical about the centerline axis 330.

In one embodiment, the keying portions 320 on the lower shaft 328 are created by applying multiple composite layers or "lay ups" to increase the outside diameter of the lower shaft 328. Subsequently, the keying portions 320 are created by cutting or machining slots parallel to the centerline axis 330 to form spline teeth along a section of the lower shaft 328. The slots are also cut in a radial direction with respect to the centerline axis 330.

The inner diameter 358 of the lower shaft 328 has a significant impact on how much frictional engagement can be created between the outer surface of the locking element 314 and the inner surface 354 of the lower shaft 328. In some embodiments, an inner diameter 358 is between about 0.400" to about 0.550" or preferably between about 0.440" to about 0.530".

Figure 4:
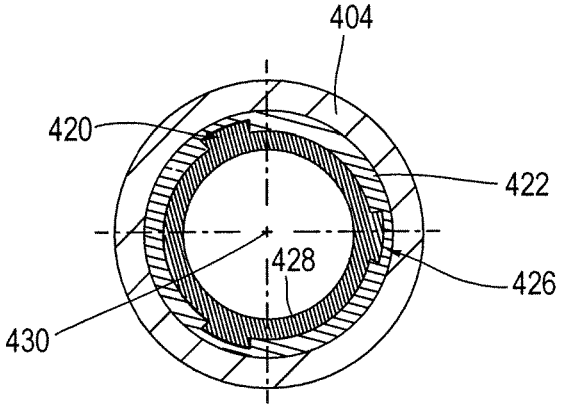
FIG. 4 illustrates a cross-sectional view according to another embodiment.

FIG. 4 shows an exemplary cross-sectional view according to another embodiment. The grip cover 404, centerline axis 430, lower shaft keying portion 420, upper shaft keying portion 426, lower shaft 428, and upper shaft 422 are shown. In one embodiment, three equidistantly spaced splines are shown being symmetric about the centerline axis 430.

Figure 5:
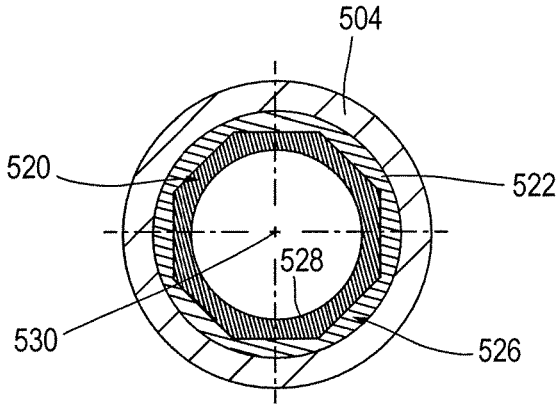
FIG. 5 illustrates a cross-sectional view according to another embodiment.

FIG. 5 illustrates an exemplary cross-sectional view according to another embodiment. The grip cover 504, centerline axis 530, lower shaft keying portion 520, upper shaft keying portion 526, lower shaft 528 and upper shaft 522 are also shown. In one embodiment, the keying portions form an octagonal shape. In some embodiments, other geometric shapes can be formed to act as a keying portion. For example, a triangular, hexagonal, pentagonal, truncated circle, square, or D-shaped contour can be used on the outer surface of the lower shaft. The geometric shape selected will conform with the USGA Rules of Golf. The geometric shape formed by the keying portions 526,520 prevents the rotation of the lower shaft 528 with respect to the upper shaft 522.

Figure 6A:
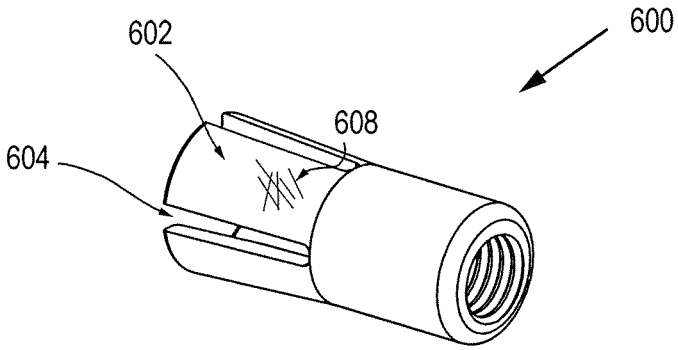
FIG. 6A illustrates an isometric view of a locking element according to one embodiment.

FIG. 6A illustrates an exemplary embodiment of a locking element 600 having four expandable members or fingers 602 within an end region. The locking element 600 includes four tabs or finger portions 602 on a lower end of the locking element 600. The finger portions 602 are formed by four slots 604 spaced equidistant from one another around a circumference of the locking element 600. It is understood that certain embodiments can have more than two slots or at least four expandable finger portions without departing from the scope of this invention. At least one advantage of having at least four expandable fingers portions 602, is that it provides an equally distributed force about the circumference of the locking element 600 and plug while engaged in the locked position. In certain embodiments, the finger portions 602 can be biased outwardly away from the centerline axis 606 so that they will engage with the engagement surface of the plug described above.

Optionally, the locking element can include a frictional coating 608 that can be applied to the outer surface of the locking collar 600. In one embodiment, the frictional coating 608 is a urethane or polyurethane coating. The frictional coating 608 can be applied to the outer surface of the base cylinder of the locking element 600 or the outer surface of the finger portions 602. In addition, it is understood that the frictional coating 608 can be applied to the entire outer surface of the locking element 600 including the finger portions 602 and the base portion.

Figure 6B:
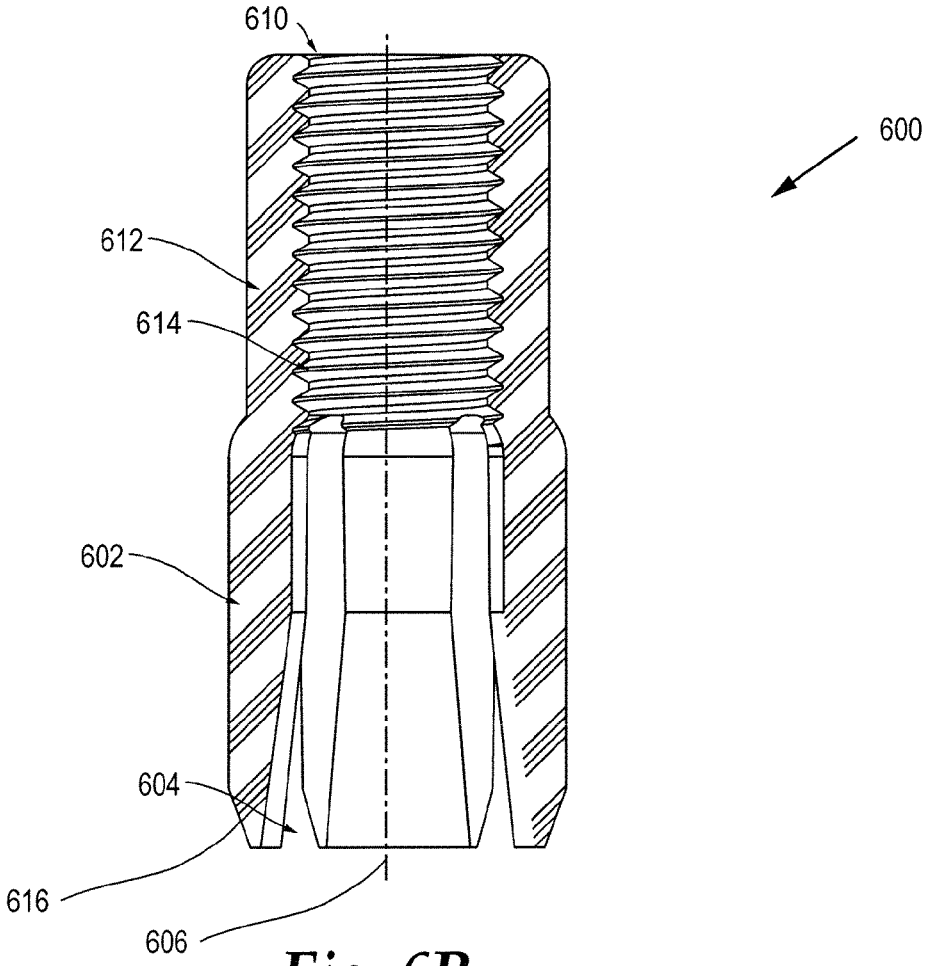
FIG. 6B illustrates a cross-sectional view of a locking element.

FIG. 6B illustrates a cross sectional view of the locking element 600 having the bore hole 610, finger portions 602, centerline 606, slots 604, threaded portion 614, and a base portion 612. The locking element 600 further includes the base portion 612 being connected with the finger portions 602. The outer diameter of the base portion 612 and finger portions 602 are frictionally engaged with the inside diameter of the lower shaft, as previously described.

In order for the present invention to function properly, the locking element 600 must be rotationally restrained within the lower shaft during a rotation of the plug while being allowed to move axially along the centerline 606 axis. Therefore, the coefficient of friction between the locking element 600 and plug is less than the coefficient of friction between the locking element 600 and lower shaft surface.

In one embodiment, the locking element 600 or plug is comprised of a glass filled polycarbonate or nylon material having a static coefficient of friction value of about 0.252 or less. In another embodiment the locking element 600 is comprised of a poly(tetrafluoroethylene) material (such as Teflon®) having a coefficient of friction value of about 0.05 or less or a polyoxymethylene material (such as Delrin®) having a coefficient of friction of about 0.192 or less. In preferred embodiments, a material having a coefficient of friction of less than about 0.5 is preferred. In other preferred embodiments, a coefficient of friction of less than about 0.3 for the locking element 600 or plug is preferred. In another exemplary embodiment, the locking element 600 can be an aluminum or low friction polished metallic material. It is understood that any low friction material described herein can be used without departing from the scope of the present invention.

In further embodiments, the locking element 600 is a low friction material described above having an outer surface of the base portion 612 and/or finger portions 602 covered in a high friction coating or spray. The friction coating or spray is provided to create increased rotational friction while allowing the collar to slide freely along an axial direction. In one embodiment, the inside surface of the lower shaft has a static coefficient of friction of about 0.80 or more.

In one embodiment, the ends of the finger portions 602 include flattened portions 616 that increase the amount of surface area contact between the locking element 600 and the inner surface of the lower shaft. The more surface area contact present, the greater the frictional engagement when the locking element is moved to the locking position. In one embodiment, the taper angle of the flattened portions 616 (away from the outer surface of the finger portions 602) is about 10 to 20 degrees or more.

Figure 6C:
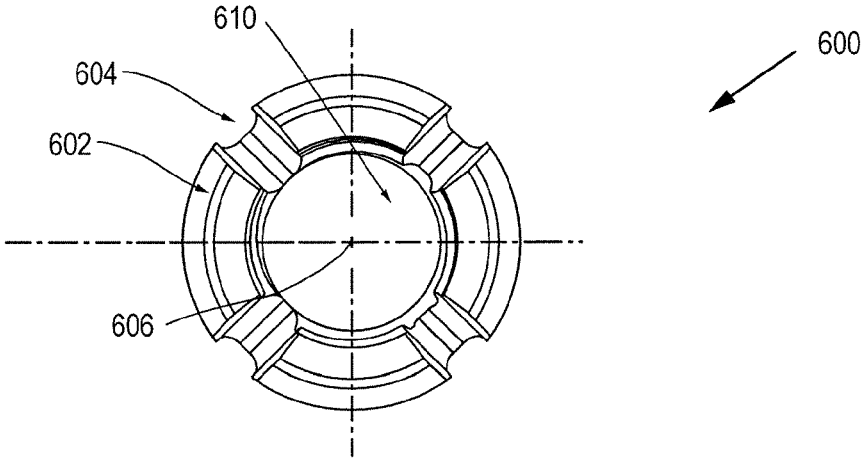
FIG. 6C illustrates a bottom view of a locking element.

FIG. 6C is a bottom view perspective of the locking element 600 including the components described above. In other embodiments, different types of locking elements can be used such as the Komperdell® Duo lock mechanism that includes a dual-wedge locking mechanism that is engaged when the drive shaft is rotated.

Figure 9A:
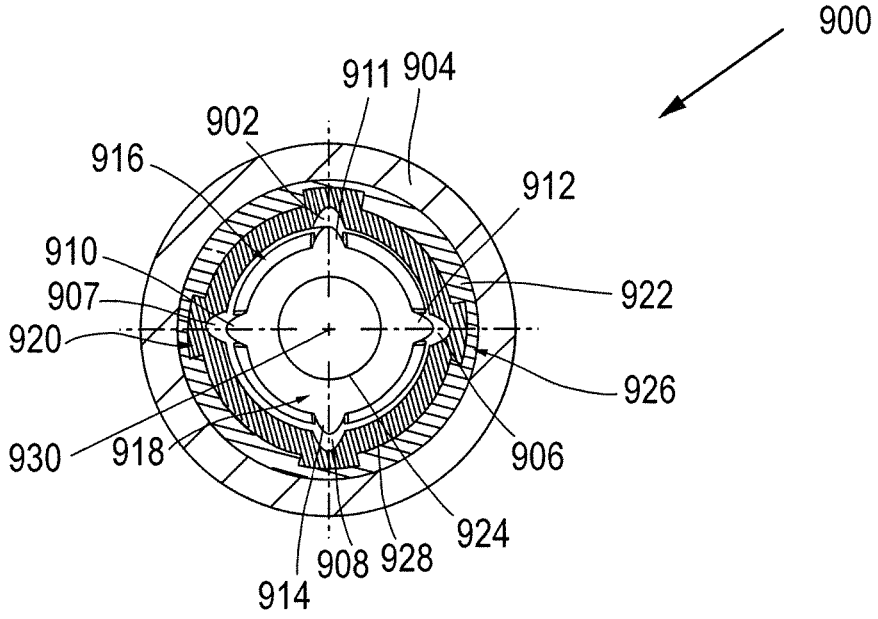
FIG. 9A illustrates a cross-sectional assembly view according to another embodiment.

FIG. 9A shows an exemplary cross-sectional assembly view according to another embodiment 900. The grip cover 904, centerline axis 930, lower shaft keying portion 920, upper shaft keying portion 926, lower shaft 928, and upper shaft 922 are shown. In one embodiment, the lower shaft keying portions 920 includes four equidistantly spaced splines that are symmetric about the centerline axis 930.

FIG. 9A further shows a locking element 918 disposed within the lower shaft 928 (as viewed from the base portion side of the locking element 918). The locking element 918 includes ribs or detents 910,911,912,914 that are equally and symmetrically spaced about the centerline axis 930 and are located on the outer surface of the base portion of the locking element 918. The ribs or detents 910,911,912,914 are configured to engage with four symmetrically spaced notches or grooves 902,906,907,908 to prevent the rotation of the locking element 918 during the rotation of the drive shaft. The locking element 918 includes a threaded opening 924 and locking fingers 916 as previously described. In one embodiment, the notches or grooves 902,906,907,908 are each located in the region of a corresponding lower shaft keying portion 920 in four locations in order to maintain the structural rigidity of the lower shaft 928. The placement of the notches or grooves 902,906,907,908 in the thickened region of the lower shaft keying portion 920 also prevents the lower shaft 928 walls from becoming too thin and subject to mechanical failure.

Figure 9B:
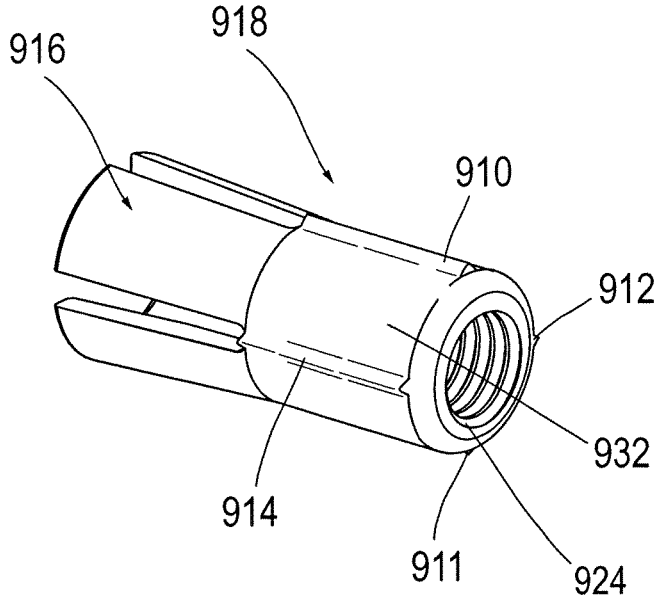
FIG. 9B illustrates an isometric view of a locking element, according to another embodiment.

FIG. 9B illustrates an isometric view of an exemplary locking element 918 including a base portion 932, finger portion 916 and ribs 910,911,912,914, and threaded opening 924 as previously described. The ribs 910,911,912,914 are positioned to be aligned with the slots 913 located in-between each finger portion 916. Therefore, the corresponding grooves 902,906,907,908 of the lower shaft 928 are also aligned with the slots 913. Thus, the fingers portions 916 engage only with the non-slotted surfaces of the lower shaft 928 to ensure greater frictional contact.

Figure 10:
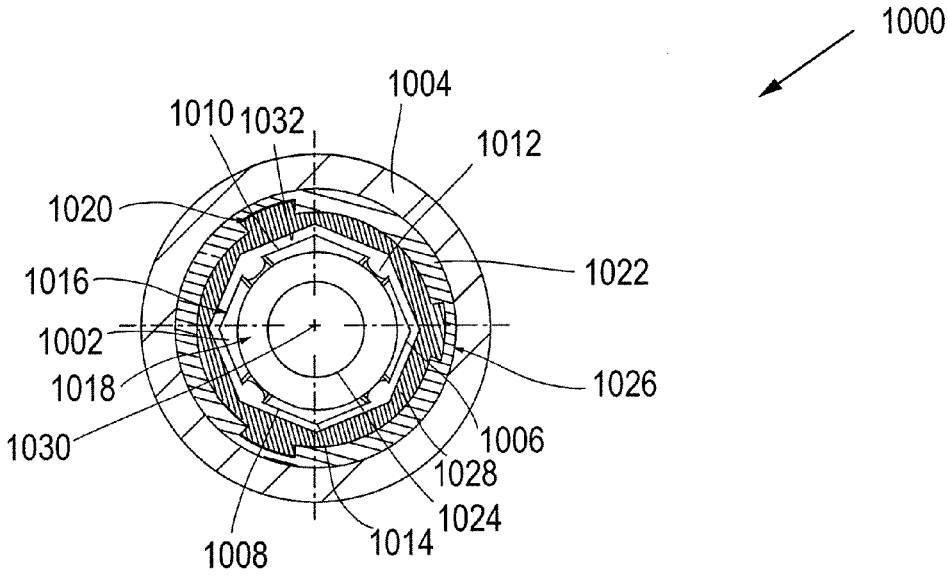
FIG. 10 illustrates a cross-sectional assembly view according to another embodiment.

FIG. 10 illustrates a cross-sectional assembly view according to another embodiment. The grip cover 1004, centerline axis 1030, lower shaft keying portion 1020, upper shaft keying portion 1026, locking element 1018, finger portions 1016, finger portion slots 1012, threaded opening 1024, lower shaft 1028, and upper shaft 1022 are shown.

In addition, the finger portions 1016 include a first finger 1002, a second finger 1008, a third finger 1006, and a fourth finger 1010. Each finger has a geometric surface that is configured to engage with the interior surface 1032 of the lower shaft 1028. In one embodiment, each finger includes at least two flat surfaces that form an apex or ridge 1014. The apex or ridge 1014 of each finger portion 1002,1008,1006,1010 engages with the interior surface 1032 of the lower shaft 1028 to prevent the rotation of the locking element 1018 upon rotation of the drive shaft.

In one embodiment, the interior surface 1032 of the lower shaft 1028 is an octagonal shape although many different shapes can be used depending on the number of fingers and corresponding surface geometries. It is understood that the ribs or detents and corresponding grooves previously described can be implemented in the embodiment of FIG. 10.

Figure 11:
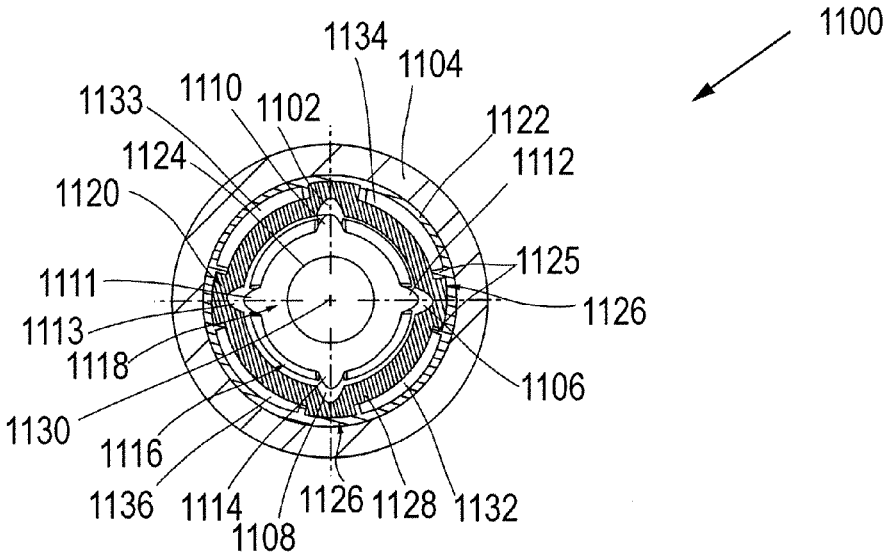
FIG. 11 illustrates a cross-sectional assembly view according to another embodiment.

FIG. 11 illustrates another cross-section assembly view according to another embodiment 1100. The grip cover 1104, centerline axis 1130, lower shaft keying portion 1120, upper shaft keying portion 1126, locking element 1118, finger portions 1116, threaded opening 1124, lower shaft 1128, and upper shaft 1122 are shown. The locking element 1118 includes a first rib 1110, second rib 1112, third rib 1114, and fourth rib 1111 on the base portion as previously described. The ribs 1110,1111,1112,1114 are received by a corresponding lower shaft 1128 first engaging groove 1102, second engaging groove 1106, third engaging groove 1108, and fourth engaging groove 1113 respectively.

In addition, the upper shaft 1122 includes at least one intermediate groove 1132,1133,1134,1136 located in between each upper shaft keying portion 1126. In one embodiment, four intermediate grooves 1132,1133,1134,1136 are provided. The intermediate grooves 1132,1133,1134,1136 are configured to remove weight from the upper shaft 1122 to reduce the weight within the weight zone while maintaining a rigid and durable structure. The upper shaft keying portions 1126 are formed by two protrusions 1125 configured to engage with the lower shaft keying portion 1120 to prevent rotation. The intermediate grooves 1132,1133,1134,1136 are located between the protrusions 1125 of the upper shaft 1122.

It is understood that selective portions of the upper shaft can include the mass saving features described above. For example, two or more sections along the centerline axis of the upper shaft 1122 can include intermediate grooves 1132, 1133,1134,1136 while other sections of the upper shaft 1122 would have a constant thin-wall diameter or no intermediate grooves.

FIGS. 12A-H illustrate several views of another embodiment of an adjustable golf club shaft. A grip cover 1204 envelopes an external surface of an upper shaft 1222. The upper shaft 1222 is coaxially aligned with a lower shaft 1228 about a centerline axis 1230. The upper shaft 1222 and lower shaft 1228 have an overlapping region where the upper shaft 1222 telescopically receives the lower shaft 1228. The lower shaft 1228 is slidably engaged with the upper shaft 1222 so that the length of the lower shaft 1228 is adjustable with respect to the upper shaft 1222. However, an engaged upper shaft keying region 1220 allows a keying portion 1226 of the lower shaft 1228 to engage with the keying portion of the upper shaft 1222 to prevent rotation of the upper shaft about the lower shaft, as will be shown in further detail below. (See, e.g., FIGS. 12A and 12E).

Figure 12A:
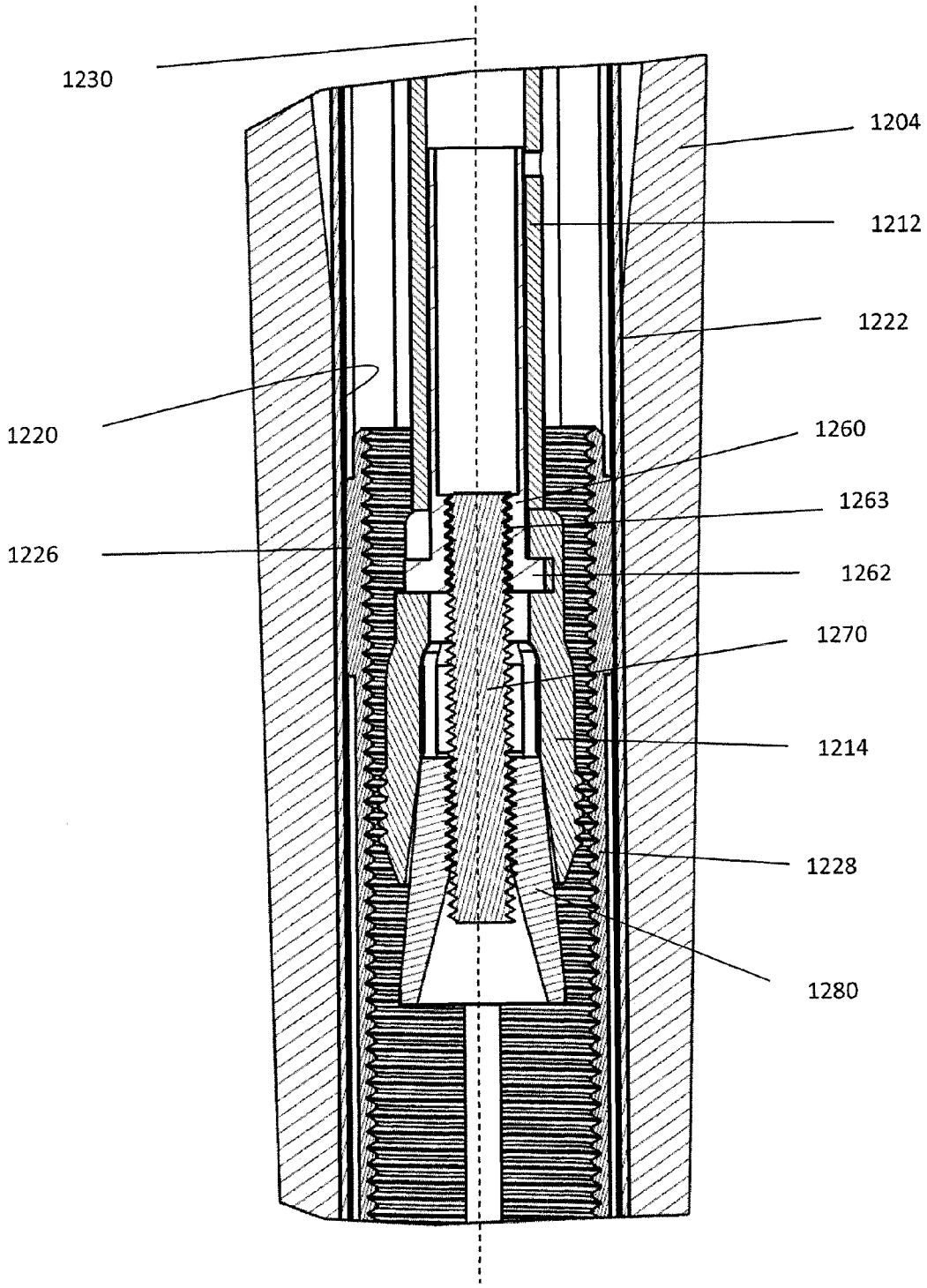
FIG. 12A is a cross-sectional assembled view of another embodiment of an adjustable shaft in an unlocked position.
Figure 12B:
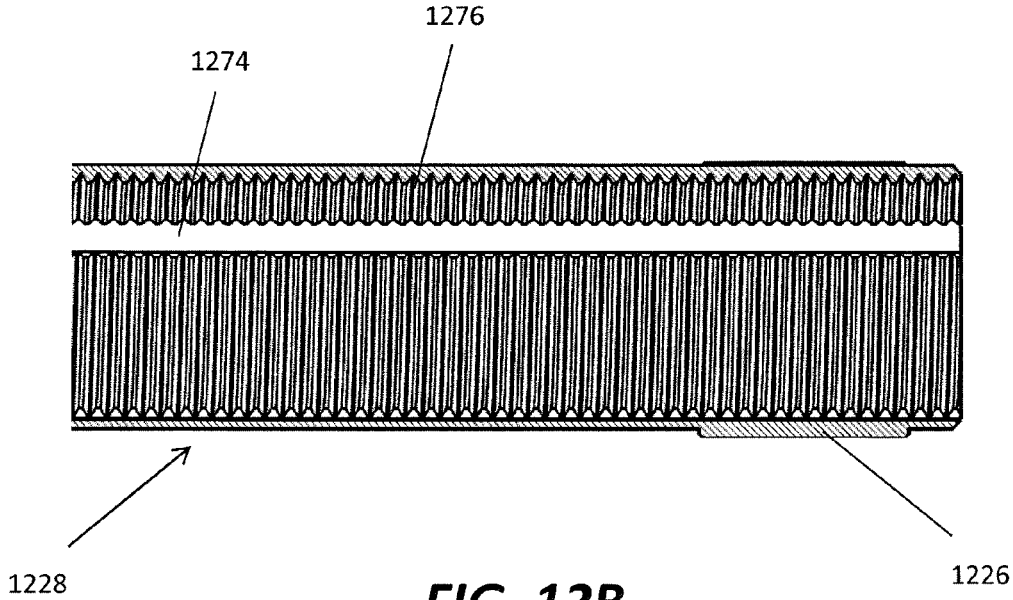
FIG. 12B is a side cross-sectional view of a lower shaft of the adjustable shaft shown in FIG. 12A.
Figure 12C:
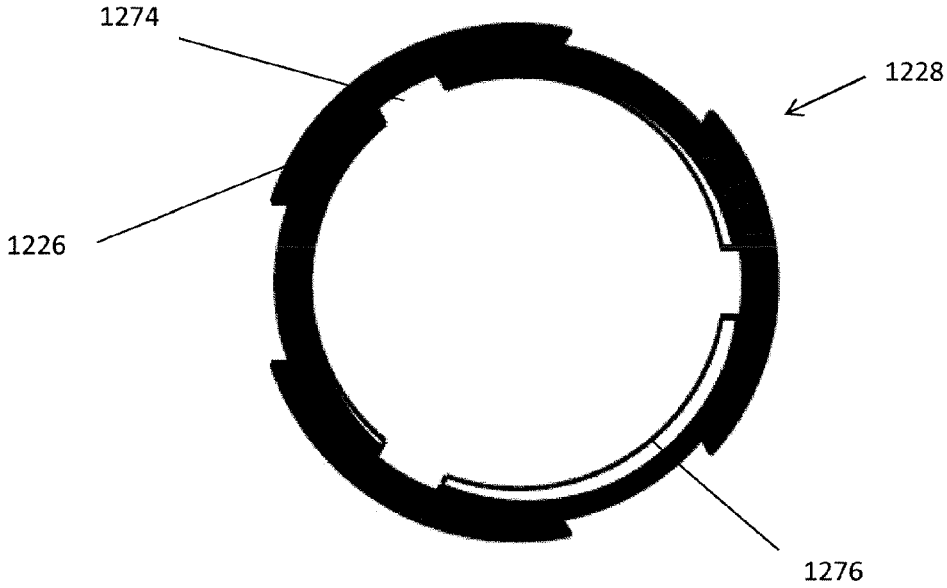
FIG. 12C is a top cross-sectional view of a lower shaft of the adjustable shaft shown in FIG. 12A.

Several features of the lower shaft 1228 are shown in more detail in FIGS. 12B and 12C. In the embodiment shown, the keying portion 1226 of the lower shaft is defined by a plurality of splines that are configured to interlock with corresponding splines defined by the keying portion 1220 of the upper shaft. In one example, the lower shaft keying portion 1226 includes three splines, though it is understood that any number of splines can be used, such as between one and sixteen splines. The interlocking lower shaft keying portion 1226 and upper shaft keying portion 1220 ensure that a rotational motion is prevented between the two shafts. The keying portions 1220, 1226 are symmetrical about the centerline axis 1230.

The internal surface of the lower shaft 1228 includes a threaded section in which a plurality of circumferential threads 1276 is disposed within the upper region of the lower shaft. In other embodiments, the internal surface of the upper region of the lower shaft includes a plurality of ridges, grooves, projections, or other indexing features adapted to selectively engage a corresponding set of indexing features located on a locking mechanism 1214, discussed more fully below. In addition, the internal surface of the lower shaft 1228 also includes a plurality of longitudinal grooves 1274 extending through the upper region of the lower shaft 1228. In the embodiment shown, three longitudinal grooves 1274 are shown, though it is understood that any number of longitudinal grooves can be used, such as between one and sixteen grooves. The longitudinal grooves 1274 are configured to engage a corresponding set of ribs or detents 1297 located on the locking mechanism 1214, discussed more fully below.

Figure 12D:
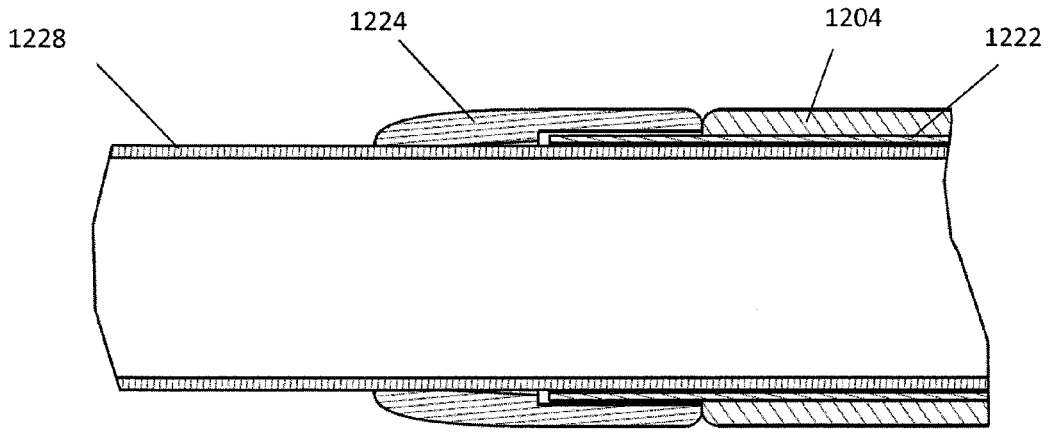
FIG. 12D is a detailed view of a stop of the adjustable shaft shown in FIG. 12A.
Figure 12E:
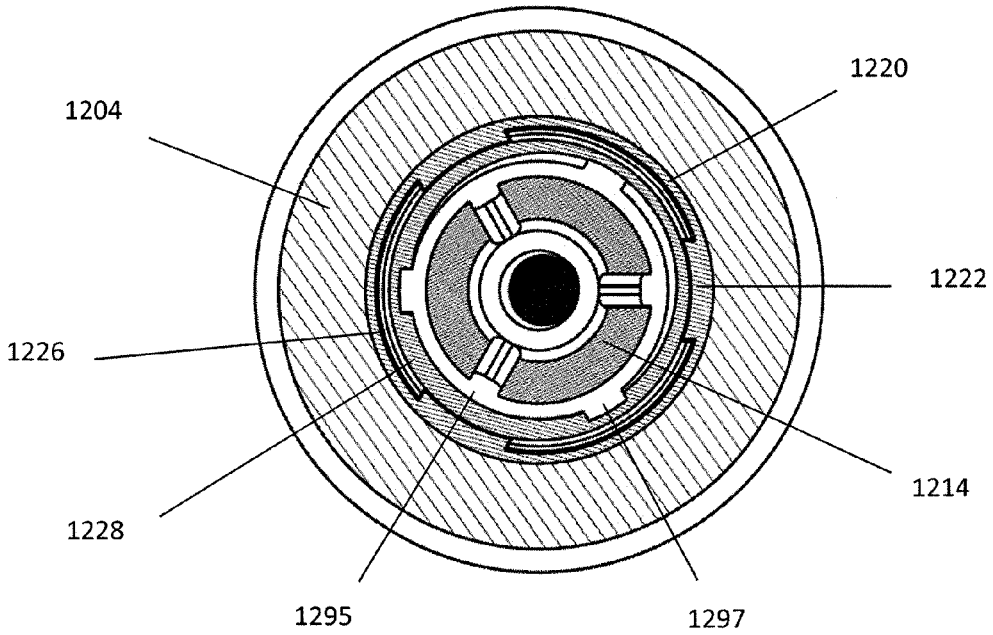
FIG. 12E is a top cross-sectional view of the assembled view of the adjustable shaft shown in FIG. 12A.

A stop 1224 is disposed on a lower end of the upper shaft 1222, as shown in FIG. 12D. In some embodiments, the stop 1224 may act as a stop that prevents the lower shaft 1228 from being completely removed from the upper shaft 1222 in the first axial direction 116, as described for the embodiments illustrated in FIG. 3D above. The stop 1224 is preferably attached, such as by adhesive bonding, to the lower end of the upper shaft 1222. In some embodiments, the stop 1224 is comprised of polyurethane.

Although not shown in FIGS. 12A-H, the adjustable golf club shaft embodiment preferably includes a grip end opening, an upper housing portion, a lower housing portion, a drive bolt, an upper washer, and a lower washer that operate in a manner similar to that described above in relation to FIGS. 3A-B. A lower portion of the drive bolt is inserted into an upper end of the drive shaft 1212, which is shown in FIG. 12A. A drive shaft extension 1260 is inserted into and attached to a lower end of the drive shaft 1212. In one embodiment, the drive bolt and drive shaft extension 1260 are each adhesively attached to the drive shaft 1212 by an adhesive epoxy along respective interface surfaces. In other embodiments, the drive bolt and/or drive shaft extension 1260 are mechanically attached or pinned with a mechanical fastener or keyed to the drive shaft 1212 to ensure the drive bolt and drive shaft extension 1260 each rotate simultaneously by the same amount as the drive shaft 1212.

The lower end of the drive shaft extension 1260 extends below the lower end of the drive shaft 1212, as shown in FIG. 12A. The drive shaft extension 1260 includes a flange 1262 disposed on its lower end, below the lower end of the drive shaft 1212. The drive shaft extension extends coaxially with the centerline axis 1230, and defines an internal bore 1261. (See FIG. 12F). The internal bore includes a threaded region 1263 at the lower end of the drive shaft extension 1260, including the region at which the flange 1262 is located. A threaded rod 1270 is disposed within the central bore 1261 of the drive shaft extension and is threadedly engaged with the threaded region 1263. In one embodiment, the threads of the threaded rod 1270 are adhesively bonded to the threaded region 1263 of the drive shaft extension by an adhesive epoxy. In other embodiments, the threaded rod 1270 is mechanically attached or pinned with a mechanical fastener or keyed to the drive shaft extension 1260 to ensure the threaded rod 1270 and drive shaft extension 1260 each rotate simultaneously by the same amount as the drive shaft 1212 and the drive bolt.

Figure 12F:
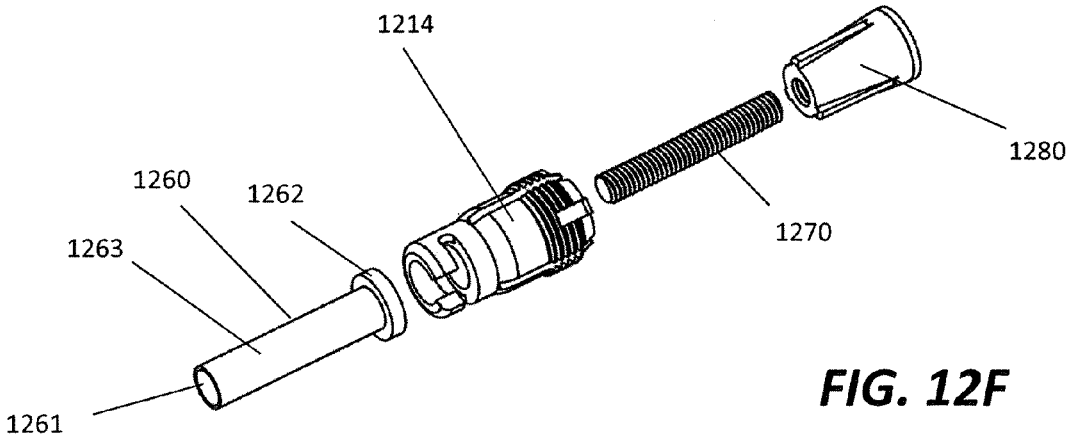
FIG. 12F is an isometric exploded view of a drive shaft extension, a locking mechanism, a threaded rod, and a ramp member of the adjustable shaft shown in FIG. 12A.
Figure 12G:
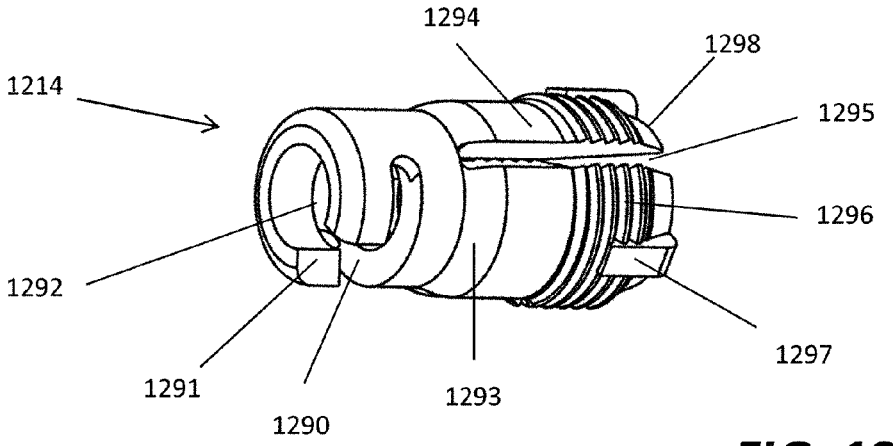
FIG. 12G is an isometric view of a locking mechanism of the adjustable shaft shown in FIG. 12A.
Figure 12H:
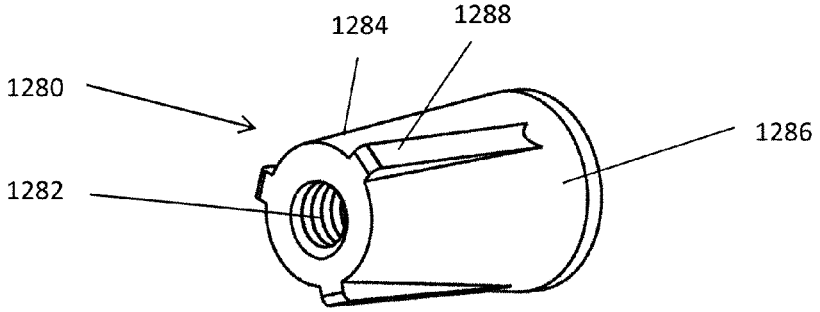
FIG. 12H is an isometric view of a ramp member of the adjustable shaft shown in FIG. 12A.

A ramp member 1280 is threaded onto a lower end of the threaded rod 1270, as shown in FIGS. 12A and 12F. The ramp member 1280 (see also FIG. 12H) includes a threaded central bore 1282 that is configured to engage the threads on the threaded rod 1270, such that the ramp member 1280 can be translated axially along the threaded rod 1270 by rotating the threaded rod 1270 relative to the ramp member 1280. Accordingly, as the threaded rod 1270 is rotated by rotating the drive bolt (not shown in FIGS. 12A-H) in either a clockwise or counterclockwise direction, the ramp member 1280 can be selectively translated axially along the threaded rod 1270 in the first axial direction 116 or the second axial direction 118. (It should be understood that the correspondence between clockwise or counterclockwise rotation of the drive bolt and axial translation of the threaded rod 1270 in the first axial direction 116 or second axial direction 118 will be dependent upon the direction of the threads on the threaded rod 1270 and the ramp member 1280, and can be provided with either correspondence). The ramp member 1280 has a generally frusto-conical external profile, having a first diameter at its lower end 1286 that is larger than a second diameter at its upper end 1284, thereby providing an inclined outer surface. A plurality of ribs or detents 1288 are provided on the outer surface, with each of the ribs or detents 1288 being configured to slidably engage a corresponding longitudinal slot 1295 located on the locking mechanism 1214, as described more fully below. In the embodiment shown, the ramp member 1280 includes three ribs or detents 1288, though it is understood that any number of ribs or detents 1288 can be used, such as between two and eight ribs or detents.

An upper end of the locking mechanism 1214 is positioned on and supported by the flange 1262 of the drive shaft extension 1260 such that the drive shaft extension 1260 and flange 1262 are able to rotate relative to and within the upper end of the locking mechanism 1214. (See FIGS. 12A, 12F, and 12G). The locking mechanism 1214 includes a central bore 1292 extending coaxially with the centerline axis 1230. A slot 1290 is provided at an upper region of the locking mechanism 1214, the slot 1290 having a size sufficient to accommodate and to allow rotation of the flange 1262 of the drive shaft extension 1260 therewithin. In addition, a notch 1291 is provided at the upper end of the locking mechanism 1214, with the notch 1291 having a size sufficient to allow the tubular body 1264 of the drive shaft extension 1260 to pass through the slot 1291. Accordingly, during assembly, the flange 1262 of the drive shaft extension can be inserted into the slot 1290 of the locking mechanism by passing the tubular body 1264 of the drive shaft extension through the notch 1291 of the locking mechanism. Once the drive shaft extension 1260 is thus positioned within the locking mechanism 1214, the threaded rod 1270 can be inserted through the central bore 1292 of the locking mechanism 1214 and threaded into and attached to the drive shaft extension 1260, and the ramp member 1280 can be threaded onto and attached to the drive rod 1270.

The locking mechanism 1214 also includes a base portion 1293 and a plurality of fingers 1294 extending from the base portion 1293 toward the lower end of the locking mechanism. Each of the fingers 1294 is separated from its adjacent fingers 1294 by a longitudinal slot 1295. In the embodiment shown, the locking mechanism 1214 includes three fingers 1294, though it is understood that any number of fingers can be used, such as between two and eight fingers. Each of the fingers 1294 includes a plurality of circumferentially oriented male threads 1296 disposed on the outer surface of the lower region of the locking mechanism 1214, with the male threads 1296 being configured to selectively engage the female threads 1276 formed on the internal surface of the lower shaft 1228. In other embodiments, the outer surfaces of each of the fingers 1294 includes a plurality of ridges, grooves, projections, or other indexing features adapted to selectively engage a corresponding set of indexing features located on the interior surface of the lower shaft 1228, as discussed above. Each of the fingers 1294 also includes a rib or detent 1297 disposed on the outer surface of the lower region of the locking mechanism 1214, with each of the ribs or detents 1297 being configured to slidably engage one of the longitudinal grooves 1274 formed on the internal surface of the lower shaft 1228. In one embodiment, the end of each of the fingers 1294 includes a flattened portion 1298. In one embodiment, the taper angle of the flattened portions 1298 (away from the outer surface of the fingers 1294) is about 10 to 20 degrees or more.

The operation of the adjustable golf club shaft embodiment shown in FIGS. 12A-H will now be described. The adjustable golf club shaft includes a locked state and an unlocked state. While in the locked state, the upper shaft 1222 and lower shaft 1228 are maintained in fixed, or locked, axial and rotational positions relative to one another. In the unlocked state, the upper shaft 1222 and lower shaft 1228 are fixed, or locked, rotationally, but the upper shaft 1222 and lower shaft 1228 are capable of axial motion relative to one another—i.e., the lower shaft 1228 is capable of sliding relative to the upper shaft 1222 in either the first axial direction 116 or the second axial direction 118. The locked or unlocked state of the adjustable golf club shaft is controlled by causing the male threads 1296 of the locking mechanism 1214 to either become engaged or disengaged with the female threads 1276 on the internal surface of the lower shaft 1228. When the male threads 1296 of the locking mechanism 1214 are engaged with the female threads 1276 of the internal surface of the lower shaft 1228, the adjustable golf club shaft is in its fixed, or locked state. When the male threads 1296 of the locking mechanism 1214 are disengaged from the female threads 1276 of the internal surface of the lower shaft 1228 (as shown, for example, in FIG. 12A), the adjustable golf club shaft is in its unlocked state.

The position of the locking mechanism 1214 is controlled by the user of the adjustable golf club shaft. In order to cause the adjustable golf club shaft to transition from the unlocked state to the locked state, the user can use a tool to engage the drive portion of the drive bolt and cause the drive bolt to rotate in a clockwise direction. This rotation of the drive bolt causes the drive shaft 1212, drive shaft extension 1260, and threaded rod 1270 to rotate in the same (clockwise) rotational direction which, in turn, causes the ramp member 1280 to translate axially in the second axial direction 118—i.e., upward, or toward the locking mechanism 1214. As the ramp member 1280 is retracted axially into the locking mechanism 1214, the fingers 1294 of the locking mechanism are biased radially outward by the force of the outer surface of the ramp member 1280 acting against the inner surface of each of the fingers 1294. As the fingers 1294 are moved radially outward, the male threads 1296 of the locking mechanism ultimately become engaged with the female threads 1276 of the internal surface of the lower shaft 1228, thereby placing the adjustable golf club shaft into the locked state.

The user can transition the adjustable golf club shaft from the locked state to the unlocked state by reversing these steps. I.e., the tool can be used to engage the drive portion of the drive bolt and cause the drive bolt to rotate in the counterclockwise direction. This causes the drive shaft 1212, drive shaft extension 1260, and threaded rod 1270 also to rotate in the counterclockwise direction, thereby causing the ramp member 1280 to translate axially in the first axial direction 116, i.e., downward, or away from the locking mechanism 1214. As the ramp member 1280 is advanced axially out of the locking mechanism 1214, the biasing force applied to the fingers 1294 by the ramp member 1280 is released, allowing the fingers 1294 to relax and the male threads 1296 to disengage from the female threads 1276 of the lower shaft 1228.

In both the locked and unlocked states of the adjustable golf club shaft, the locking mechanism 1214 and ramp member 1280 are prevented from rotational movement relative to the lower shaft 1228. The ribs or detents 1297 on the fingers of the locking mechanism 1214 have a sufficient radial profile that the ribs or detents 1297 extend into the longitudinal grooves 1274 formed on the lower shaft 1228 during both the locked and unlocked states of the adjustable golf club shaft. Accordingly, rotational movement of the locking mechanism 1214 relative to the lower shaft 1228 is thereby prevented. Similarly, the ribs or detents 1288 located on the external surface of the ramp member 1280 have a sufficient radial profile that the ribs or detents 1288 extend into the longitudinal slots 1295 formed on the locking mechanism 1214 during both the locked and unlocked states of the adjustable golf club shaft. Accordingly, rotational movement of the ramp member 1280 relative to the locking mechanism 1214 is thereby prevented.

Figure 7A:
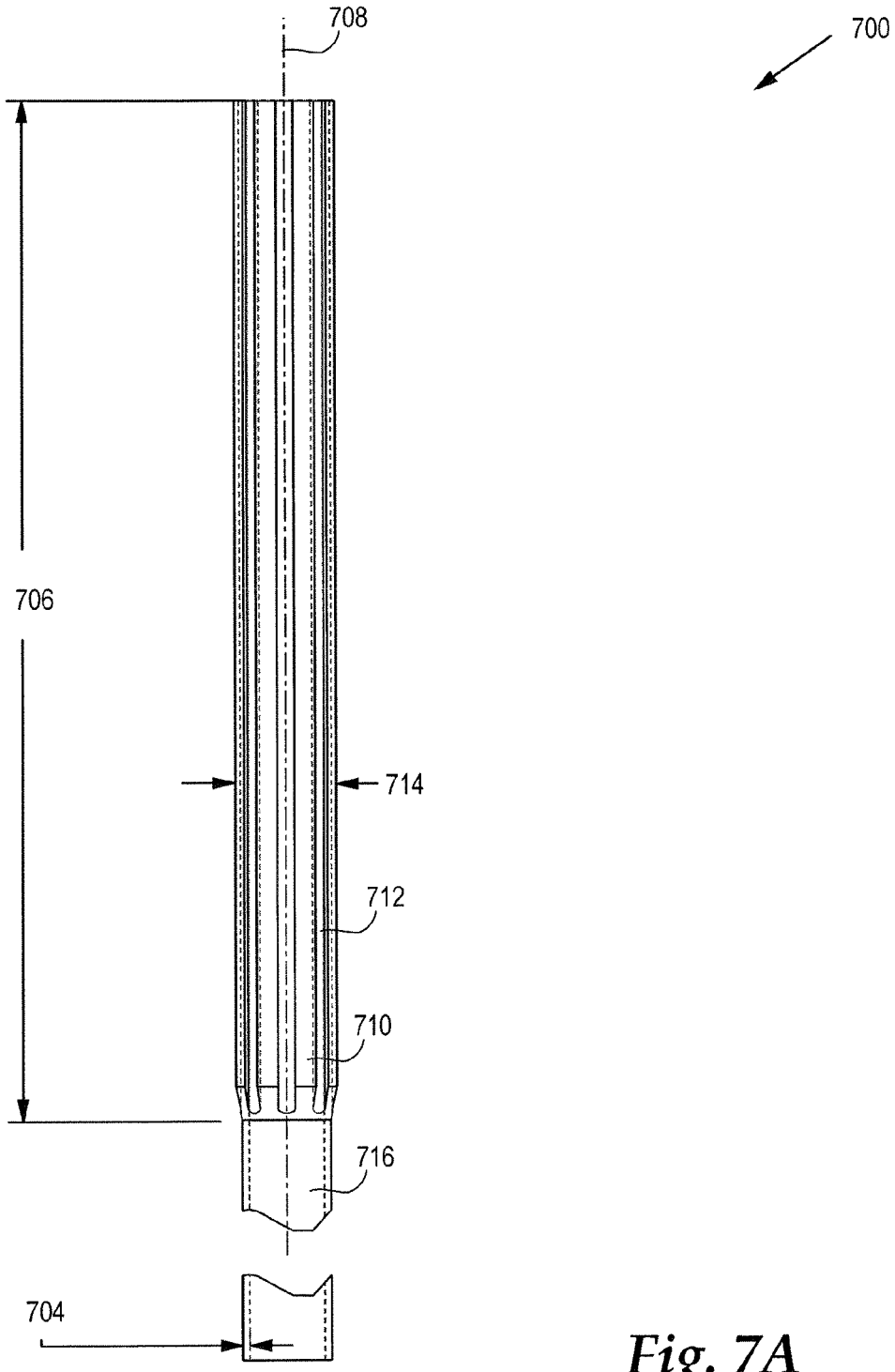
FIG. 7A illustrates a lower shaft having a keying portion.

FIG. 7A illustrates an exemplary lower shaft 700 including a centerline axis 708, keying portion length 706, keying portion 710, and slots 712 as previously described. In addition, the lower shaft 700 includes a keying portion 706 first outside diameter 714 and a non-keying portion 716 having a second outside diameter. The non-keying portion 716 also has a shaft wall thickness 704. In some embodiments, the shaft wall thickness 704 is between about 0.5 mm and 1.5 mm or preferably about 1 mm.

In some embodiments, the first outside diameter 714 is between about 0.500" and about 0.700". In one embodiment, the first outside diameter 714 is about 0.600" or about 0.680".

The length 706 of the keying portion 710 has an axial length between about 101.6 mm (4") and about 279.4 mm (11"). In one embodiment, the keying portion 706 has an axial length of about 254 mm (10") or about 148 mm (5.8"). It is understood that the keying portion 710 can be provided in multiple segments. For example, two, three, or more keying portions 710 can be intermittently provided on the lower shaft 700 within the keying portion lengths 706 described above. For ease of illustration, only one keying portion 710 is shown in FIG. 7A.

Figure 7B:
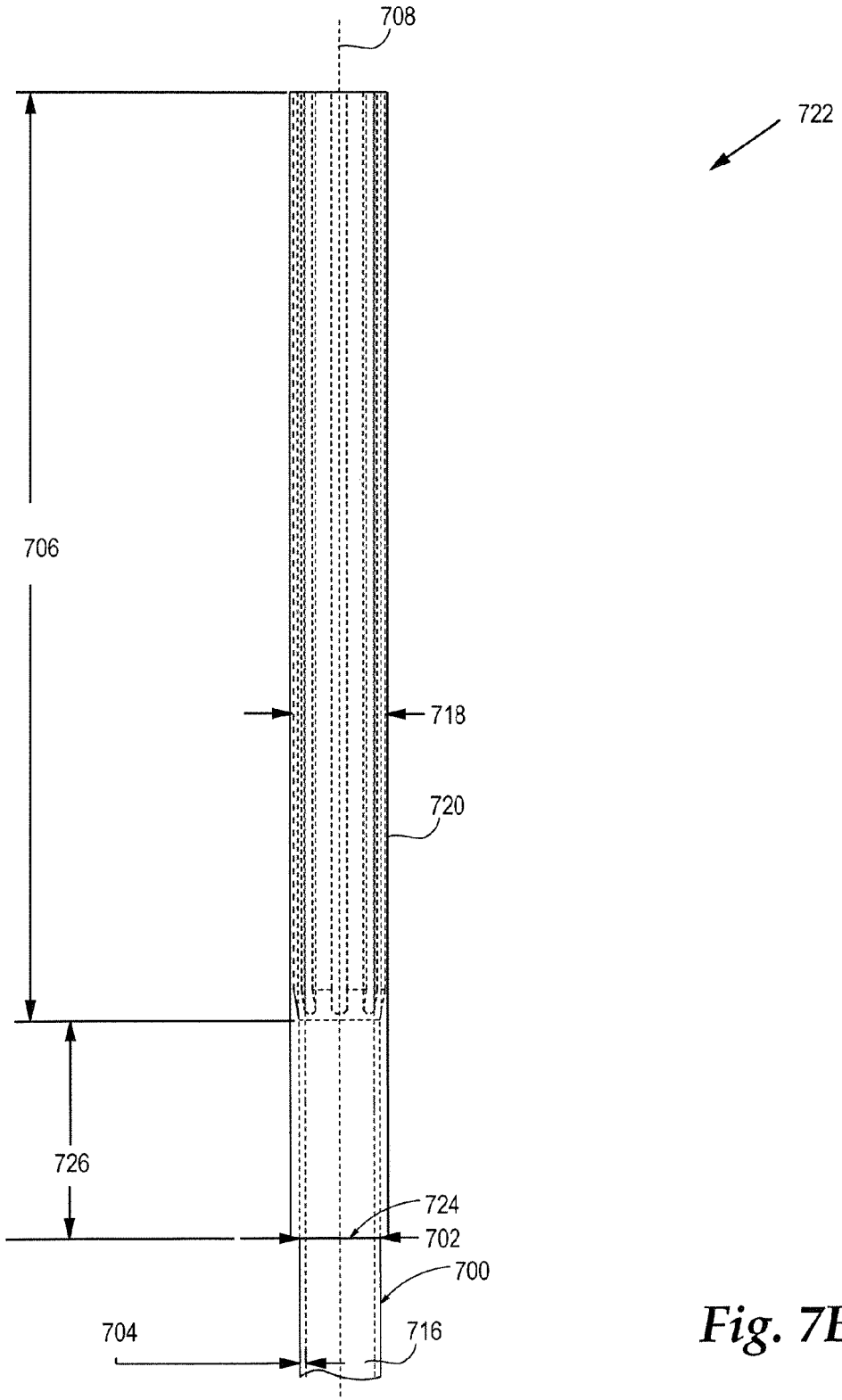
FIG. 7B illustrates a lower shaft assembled with an upper shaft.
Figure 8:
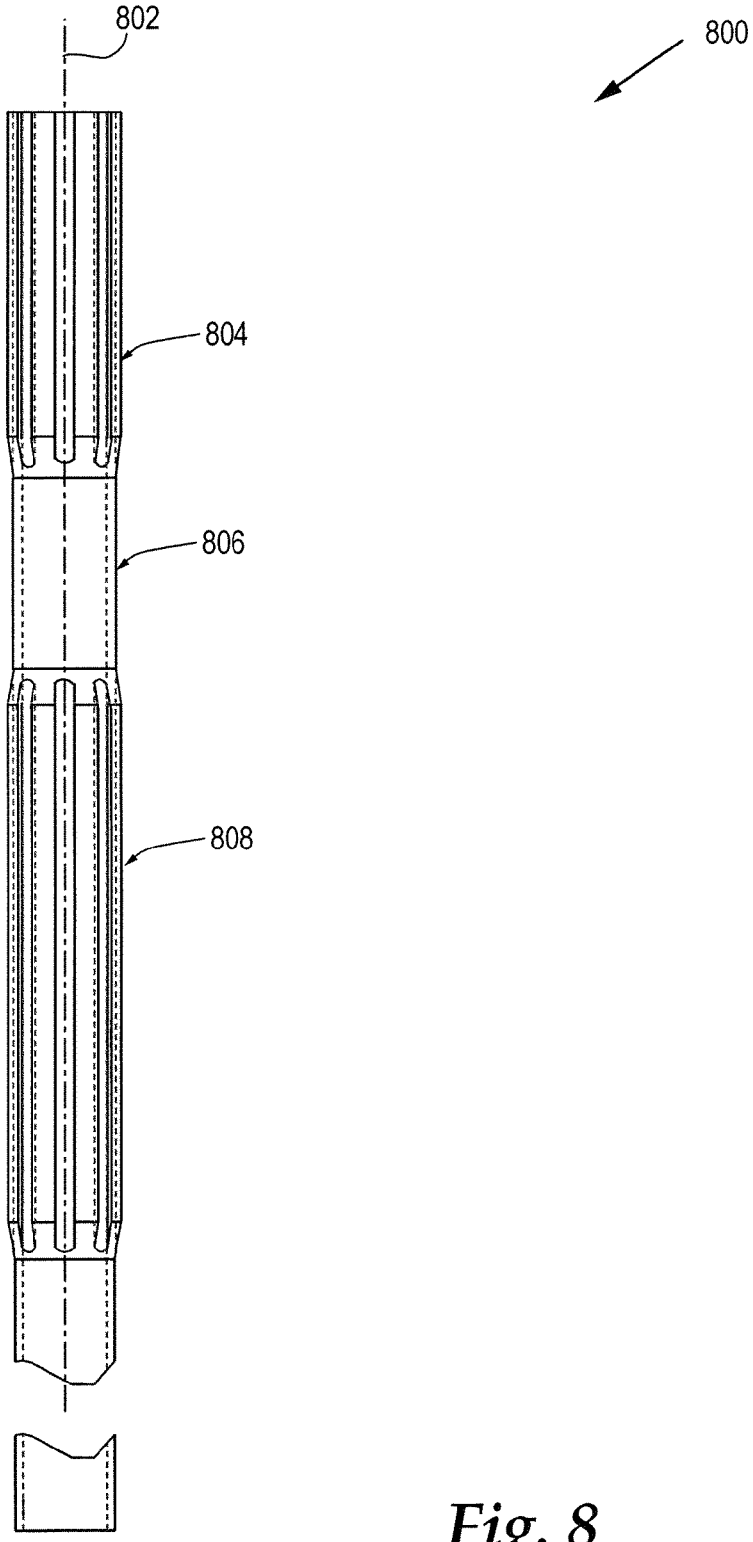
FIG. 8 illustrates a lower shaft with multiple keying portions.

However, FIG. 8 illustrates an alternative embodiment where multiple sections 804,808 of keying portions are provided with at least one intermittent non-keying portion 806 in between the multiple keying portions 804,808. Providing at least one intermittent non-keying portion 806 can also help reduce weight in the weight zone portion of the shaft. Moreover, FIGS. 12A-H illustrate yet another alternative embodiment where a single keying portion 1226 is provided only near the upper end of the lower shaft 1228. The single keying portion 1226 is relatively shorter axially than the keying portions described above in relation to FIGS. 7A-B and FIG. 8, having an axial length of from about 12.7 mm (0.5") to about 38.1 mm (1.5").

FIG. 7B illustrates an assembled view 722 of the lower shaft 700 with the upper shaft 720 prior to having the grip cover attached. The upper shaft 720 includes an upper shaft outside diameter 718 between about 0.600" and 0.700". In some embodiments, the second outside diameter 702 of the lower shaft 700, at an upper shaft 720 end region 724, is between about 0.450" and 0.600". The second outside diameter 702 of the non-keying portion 716 of the lower shaft 700 at the axial location where the upper shaft 720 ends 724 should be large enough to reduce the amount of step between the lower shaft 700 and upper shaft 720. In one embodiment, the second outside diameter 702 is measured on the lower shaft 700 in the end region 724 when the upper shaft 720 is fully engaged in a first axial direction 116.

In other words, the upper shaft 720 is fully contracted and has a maximum overlap dimension 726. The overlap dimension 726 is defined as the axial distance the upper shaft 720 overlaps with the non-keying portion 716. The overlap dimension 726 can also represent the amount of adjustability possible by the user before the keying portion 710 of the lower shaft 700 is undesirably exposed. The overlap dimension 726 can be between about 1" and about 11". In one embodiment, the overlap dimension is between about 3" and 10".

In order for the adjustable shaft assembly to feel "normal" to a user, the difference between the upper shaft 720 outside diameter 718 and the second outside diameter 702 of the non-keying portion 716 should be minimized. In other words, the transition in relative diameters between the upper shaft outside diameter 718 and the second outside diameter 702 (of the lower shaft) at the end region 724 axial location includes a relatively small step. In embodiments where the upper shaft is tapered, the outside diameter 718 is measured at the end region 724 of the upper shaft 720.

The relationship between the lower shaft second outside diameter 702 and the upper shaft 720 outside diameter 718 influences whether the golf club shaft will have the same feel of a traditional, non-adjustable shaft. For example, an outside diameter 718 of the upper shaft 720 that is too large will influence the golfer's grip and feel negatively. Thus, an outside diameter 718 of the upper shaft 720 that is less than 0.700" (constant diameter) is desired.

Table 1 shows exemplary embodiments with an overlap dimension 726 of about 4". Each exemplary embodiment shows a specific upper shaft 720 outside diameter 718 range and a corresponding lower shaft second outside diameter 702 at the end region 724 axial location.

| Example No. | Upper Shaft O.D. (inches) | Lower Shaft O.D. (inches) |
|---|---|---|
| 1 | ≤0.700 | ≥0.450 |
| 2 | ≤0.700 | ≥0.500 |
| 3 | ≤0.700 | ≥0.550 |
| 4 | ≤0.650 | ≥0.450 |
| 5 | ≤0.650 | ≥0.500 |
| 6 | ≤0.650 | ≥0.520 |
| 7 | ≤0.650 | ≥0.530 |
| 8 | ≤0.650 | ≥0.540 |
| 9 | ≤0.650 | ≥0.550 |
| 10 | ≤0.650 | ≥0.560 |
| 11 | ≤0.650 | ≥0.570 |
| 12 | ≤0.650 | ≥0.580 |
| 13 | ≤0.650 | ≥0.590 |
| 14 | ≤0.650 | ≥0.600 |

As illustrated by the exemplary embodiments shown in Table 1, the upper shaft 720 outside diameter 718 is desirably below the threshold values shown. Given a smaller upper shaft 720 outside diameter 718, a more traditional upper shaft feel is provided to the user.

In addition, the lower shaft second outside diameter 702 at the end region 724 location of the upper shaft 720 should be sufficiently larger than the threshold values shown above to provide the appearance of a smooth or small step transition from the upper shaft 720 to the lower shaft 716.

One advantage of the embodiments described herein is that an effective locking element is provided within a shaft that can handle a large amount of rotational or axial force while providing a traditional feel and grip for the golfer. In some embodiments, an axial force of at least 500 N or 2000 N when applied to the longitudinal axis of the shaft does not cause any movement between the upper and lower shaft whatsoever. In addition, the upper and lower shafts can withstand torsional forces of at least 5 N-m to 10 N-m without allowing any movement between the two shafts. In some embodiments, the upper and lower shaft can withstand up to 600 N-m or 700 N-m without failure.

Another advantage of the embodiments of the present invention is that a relatively low number of turns are required by the user to lock and unlock the locking elements described above. In certain embodiments, less than one full rotation is required to lock or unlock the upper and lower shafts. Thus, a user can easily and quickly adjust the length of the shaft without a large amount of effort.

Another advantage of the embodiments of the present invention is that a reliable and effective arrangement is provided to efficiently lock and unlock an upper and lower shaft. In embodiments where the upper shaft is a composite material, a lightweight adjustable grip portion is described herein. In addition, the components described herein are produced and assembled to be free of rattle and noise that might be undesirable to a user.

Furthermore, another advantage of the embodiments of the present invention is that an adjustable shaft is provided that aesthetically looks normal to a user on the exterior. The adjustable shaft can also be re-gripped with a standard or oversized replacement grip after the original grip is worn or no longer desired.

Another significant advantage of the embodiments described herein is that the grip appears "normal" in appearance and weight while providing a lightweight locking system. Minimizing weight is an advantage and therefore carbon fiber, aluminum, titanium, magnesium, and plastic would be used were strength and durability requirements allow. The present embodiments minimize overall weight by having the anti-rotation or keying features integrally incorporated into the grip. If an underlisting type grip is used, a rigid plastic or molded composite piece can be made with anti-rotation features and an additional sliding tube will not be necessary. Thus, the overall part count and weight are reduced within a weight zone.

Any of the embodiments described herein can be configured to have any total club length. For example, a total club length of the embodiments described herein can be adjusted to about 1092.2 mm (43"), 1117.6 mm (44"), 1143 mm (45"), 1168.4 mm (46"), 1193.8 mm (47"), or 1219.2 mm (48"). In one embodiment, the length of the club can be a length in the range of about 38" to 48".

The lower shaft of the embodiments described herein can include a shaft tip and hosel insert construction as described in U.S. patent application Ser. Nos. 12/346,747 and 12/474,973, herein incorporated by reference in their entirety. Specifically, the shaft tip of the lower shaft would include a hosel insert capable of being removed from the club head and repositioned to create a change in the loft, lie, or face angle of the club head.

The length of the club is measured according to the USGA Rules of Golf, Appendix II entitled "Length," which is incorporated by reference in its entirety. Specifically, for woods and irons, the measurement of length is taken when the club is lying on a horizontal plane and the sole of the club head is set against a 60 degree plane. The length is defined as the distance from the point of the intersection between the two planes (horizontal plane and 60 degree plane) to the top of the grip.

MATERIALS

The components of the above described components disclosed in the present specification can be formed from any of various suitable metals, metal alloys, polymers, composites, or various combinations thereof.

In addition to those noted above, some examples of metals and metal alloys that can be used to form the components of the connection assemblies include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the components include, without limitation, thermoplastic materials (e.g., polyethylene, polypropylene, polystyrene, acrylic, PVC, ABS, polycarbonate, polyurethane, polyoxymethylene, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®). Furthermore, any of the above components can be made of nylon or glass filled nylon material and an injection molding process can be utilized in the production of any of the components mentioned herein.

In view of the many possible embodiments to which the principles of the disclosed invention may be applied, it should be recognized that the illustrated embodiments are only preferred examples of the invention and should not be taken as limiting the scope of the invention. For example, although a metal wood shaft is specifically described above, it is understood that the present invention can be applied to other golf club shafts including putters or irons. It will be evident that various modifications may be made thereto without departing from the broader spirit and scope of the invention as set forth. The specification and drawings are, accordingly, to be regarded in an illustrative sense rather than a restrictive sense.

We claim:

1. An adjustable length golf club shaft comprising:

a grip portion, the grip portion having an end region including an end point and further including an upper shaft;

a locking element located within the grip portion, the locking element having a first indexing member on an exterior surface thereof;

a ramp member located within the grip portion, the ramp member being configured to translate axially relative to the locking element; and a lower shaft having a second indexing member on an inner surface thereof that is in selective engagement with the first indexing member of the locking element;

wherein the first indexing member of the locking element is configured to engage the second indexing member of the lower shaft when the ramp member is translated axially relative to the locking element.

2. The adjustable length golf club shaft of claim 1, wherein the grip portion is adjustable with respect to the lower shaft and a stop prevents the lower shaft from being completely removed from the grip portion.

3. The adjustable length golf club shaft of claim 1, wherein the total length of the golf club shaft is adjustable by a distance of at least 2 inches.

4. The adjustable length golf club shaft of claim 1, wherein the total length of the golf club shaft is adjustable by a distance of at least 3 inches.

5. The adjustable length golf club shaft of claim 1, wherein the total length of the golf club shaft is adjustable by a distance of at least 4 inches.

6. The adjustable length golf club shaft of claim 1, wherein the engagement of the locking element with the lower shaft prevents any axial movement between the grip portion and the lower shaft during an axial load of at least 2000 N.

7. The adjustable length golf club shaft of claim 1, wherein the lower shaft includes at least one first keying feature portion being symmetrical about the central axis.

8. The adjustable length golf club shaft of claim 7, wherein the grip portion includes at least one second keying feature portion configured to engage with the at least one first keying feature portion.

9. The adjustable length golf club shaft of claim 7, wherein the at least one first keying portion includes at least one spline.

10. The adjustable length golf club shaft of claim 9, wherein the at least one spline includes at least three splines.

11. The adjustable length golf club shaft of claim 1, wherein the total golf club length is between about 40" and about 48".

12. The adjustable length golf club shaft of claim 1, wherein the grip portion includes an upper shaft portion having an outside diameter of less than 0.700" and the lower shaft includes an outside diameter of greater than 0.450".

13. The adjustable length golf club shaft of claim 1, wherein the grip portion includes an upper shaft portion having an outside diameter of less than 0.650" and the lower shaft includes an outside diameter of greater than 0.500".

14. The adjustable length golf club shaft of claim 1, wherein the grip portion further comprises a grip cover.

15. The adjustable length golf club shaft of claim 1, wherein a total weight of the golf club shaft in a weight zone is less than 110 g, the weight zone being defined as a region of the golf club shaft extending from the end point of the grip portion to 11" along a central axis of the golf club shaft toward a tip portion of the shaft.

16. The adjustable length golf club shaft of claim 1, wherein the locking element comprises a base portion and a plurality of fingers extending from the base portion, with each finger being separated from an adjacent finger by a longitudinal slot.

17. The adjustable length golf club shaft of claim 16, wherein the first indexing member comprises a plurality of male threads disposed on the exterior surface of the fingers of the locking element.

18. The adjustable length golf club shaft of claim 17, wherein the second indexing member comprises a plurality of female threads formed on the inner surface of the lower shaft.

19. The adjustable length golf club shaft of claim 16, wherein the ramp member comprises at least one tab configured to slidably engage a longitudinal slot of the locking mechanism.

20. The adjustable length golf club shaft of claim 16, wherein the locking element further comprises at least one tab configured to slidably engage a longitudinal groove formed on the inner surface of the lower shaft.

* * * * *